US010755655B2

(12) United States Patent
Li et al.

(10) Patent No.: US 10,755,655 B2
(45) Date of Patent: Aug. 25, 2020

(54) SOURCE DRIVER AND OPERATION METHOD FOR IMPROVING DISPLAY QUALITY

(71) Applicant: Novatek Microelectronics Corp., Hsinchu (TW)

(72) Inventors: Jen-Wei Li, Taichung (TW); Jen-Hao Liao, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/247,595

(22) Filed: Jan. 15, 2019

(65) Prior Publication Data

US 2019/0221175 A1 Jul. 18, 2019

Related U.S. Application Data

(60) Provisional application No. 62/618,590, filed on Jan. 17, 2018.

(51) Int. Cl.

| | |
|---|---|
| ***G09G 3/36*** | (2006.01) |
| ***G09G 3/3275*** | (2016.01) |
| ***G09G 3/3258*** | (2016.01) |

(52) U.S. Cl.

CPC ..... *G09G 3/3607* (2013.01); *G09G 3/3258* (2013.01); *G09G 3/3275* (2013.01);

(Continued)

(58) Field of Classification Search

CPC ..... G09G 3/0264; G09G 3/2044–2066; G09G 3/3614; G09G 3/3258; G09G 3/3685;

(Continued)

(56) References Cited

U.S. PATENT DOCUMENTS

| | | |
|---|---|---|
| 7,205,970 B2 | 4/2007 | Kim et al. |
| 7,369,075 B2 | 5/2008 | Ishii et al. |

(Continued)

FOREIGN PATENT DOCUMENTS

| | | |
|---|---|---|
| CN | 1404029 | 3/2003 |
| CN | 1790917 | 6/2006 |

(Continued)

OTHER PUBLICATIONS

"Office Action of China Counterpart Application", dated May 6, 2020, p. 1-p. 12.

*Primary Examiner* — Xuemei Zheng
(74) *Attorney, Agent, or Firm* — JCIPRNET

(57) ABSTRACT

A source driver and an operation method thereof are provided. The source driver includes a chopper circuit and a source driver circuit. A first sub-pixel and a second sub-pixel are temporally or spatially adjacent to each other. The chopper circuit adds original gray-scale data of the first sub-pixel with a first value to serve as new gray-scale data of the first sub-pixel and deducts original gray-scale data of the second sub-pixel by a second value to serve as new gray-scale data of the second sub-pixel. The source driver circuit generates a first driving voltage for the first sub-pixel according to the new gray-scale data of the first sub-pixel and generates a second driving voltage for the second sub-pixel according to the new gray-scale data of the second sub-pixel.

42 Claims, 16 Drawing Sheets

(52) U.S. Cl.
CPC ..... *G09G 3/3614* (2013.01); *G09G 3/3685* (2013.01); *G09G 2300/0828* (2013.01); *G09G 2310/0264* (2013.01); *G09G 2310/0291* (2013.01)

(58) Field of Classification Search
CPC ..... G09G 3/2074; G09G 3/2022; G09G 2310/0264; G09G 2310/08; G09G 2310/027; G09G 2310/0291; G09G 2320/0233; G09G 2320/0223; G09G 2320/0247; G09G 2320/0242; G09G 2320/0276; G09G 2320/0257; G09G 2300/0866; G09G 3/3285; G09G 3/3275; G09G 3/2051
See application file for complete search history.

(56) References Cited

U.S. PATENT DOCUMENTS

| | | | | |
|---|---|---|---|---|
| 7,443,234 | B2 | 10/2008 | Iriguchi | |
| 7,948,418 | B2 | 5/2011 | Cho et al. | |
| 7,973,973 | B2 | 7/2011 | Nose et al. | |
| 9,172,390 | B2 | 10/2015 | Cheng et al. | |
| 2003/0058211 | A1 | 3/2003 | Kim et al. | |
| 2006/0132344 | A1 | 6/2006 | Ishii et al. | |
| 2007/0126688 | A1 | 6/2007 | Woo et al. | |
| 2007/0236289 | A1 | 10/2007 | Iriguchi | |
| 2007/0268524 | A1 | 11/2007 | Nose et al. | |
| 2010/0231564 | A1 | 9/2010 | Min et al. | |
| 2014/0009506 | A1 | 1/2014 | Cheng et al. | |
| 2014/0035962 | A1* | 2/2014 | Izumi | G09G 3/30 345/690 |
| 2015/0381197 | A1 | 12/2015 | Cheng et al. | |
| 2016/0335951 | A1* | 11/2016 | Ku | G09G 3/3688 |

FOREIGN PATENT DOCUMENTS

| | | |
|---|---|---|
| CN | 101043207 | 9/2007 |
| CN | 101075415 | 11/2007 |
| CN | 101303834 | 11/2008 |
| CN | 103578421 | 2/2014 |
| CN | 106157906 | 11/2016 |
| KR | 20080002123 | 1/2008 |
| TW | 201403562 | 1/2014 |
| TW | 201640486 | 11/2016 |

* cited by examiner

| Frame-1 | | | | | | | |
|---|---|---|---|---|---|---|---|
| + | + | + | + | + | + | + | + |
| + | + | + | + | + | + | + | + |
| + | + | + | + | + | + | + | + |
| + | + | + | + | + | + | + | + |
| + | + | + | + | + | + | + | + |
| + | + | + | + | + | + | + | + |
| + | + | + | + | + | + | + | + |
| + | + | + | + | + | + | + | + |

| Frame-2 | | | | | | | |
|---|---|---|---|---|---|---|---|
| − | − | − | − | − | − | − | − |
| − | − | − | − | − | − | − | − |
| − | − | − | − | − | − | − | − |
| − | − | − | − | − | − | − | − |
| − | − | − | − | − | − | − | − |
| − | − | − | − | − | − | − | − |
| − | − | − | − | − | − | − | − |
| − | − | − | − | − | − | − | − |

FIG. 9

| Frame-1 | | | | | | | |
|---|---|---|---|---|---|---|---|
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |

| Frame-2 | | | | | | | |
|---|---|---|---|---|---|---|---|
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |

FIG. 10

| Frame-1 | | | | | | | |
|---|---|---|---|---|---|---|---|
| + | + | + | + | + | + | + | + |
| + | + | + | + | + | + | + | + |
| − | − | − | − | − | − | − | − |
| − | − | − | − | − | − | − | − |
| + | + | + | + | + | + | + | + |
| + | + | + | + | + | + | + | + |
| − | − | − | − | − | − | − | − |
| − | − | − | − | − | − | − | − |

| Frame-2 | | | | | | | |
|---|---|---|---|---|---|---|---|
| + | + | + | + | + | + | + | + |
| + | + | + | + | + | + | + | + |
| − | − | − | − | − | − | − | − |
| − | − | − | − | − | − | − | − |
| + | + | + | + | + | + | + | + |
| + | + | + | + | + | + | + | + |
| − | − | − | − | − | − | − | − |
| − | − | − | − | − | − | − | − |

FIG. 11

| Frame-1 | | | | | | | |
|---|---|---|---|---|---|---|---|
| + | + | + | + | + | + | + | + |
| − | − | − | − | − | − | − | − |
| − | − | − | − | − | − | − | − |
| + | + | + | + | + | + | + | + |
| + | + | + | + | + | + | + | + |
| − | − | − | − | − | − | − | − |
| − | − | − | − | − | − | − | − |
| + | + | + | + | + | + | + | + |

| Frame-2 | | | | | | | |
|---|---|---|---|---|---|---|---|
| + | + | + | + | + | + | + | + |
| − | − | − | − | − | − | − | − |
| − | − | − | − | − | − | − | − |
| + | + | + | + | + | + | + | + |
| + | + | + | + | + | + | + | + |
| − | − | − | − | − | − | − | − |
| − | − | − | − | − | − | − | − |
| + | + | + | + | + | + | + | + |

FIG. 12

| Frame-1 | | | | | | | |
|---|---|---|---|---|---|---|---|
| + | + | + | + | + | + | + | + |
| − | − | − | − | − | − | − | − |
| − | − | − | − | − | − | − | − |
| + | + | + | + | + | + | + | + |
| − | − | − | − | − | − | − | − |
| + | + | + | + | + | + | + | + |
| + | + | + | + | + | + | + | + |
| − | − | − | − | − | − | − | − |

| Frame-2 | | | | | | | |
|---|---|---|---|---|---|---|---|
| + | + | + | + | + | + | + | + |
| − | − | − | − | − | − | − | − |
| − | − | − | − | − | − | − | − |
| + | + | + | + | + | + | + | + |
| − | − | − | − | − | − | − | − |
| + | + | + | + | + | + | + | + |
| + | + | + | + | + | + | + | + |
| − | − | − | − | − | − | − | − |

FIG. 13

| Frame-1 | | | | | | | |
|---|---|---|---|---|---|---|---|
| + | + | + | − | − | − | + | + |
| + | + | + | − | − | − | + | + |
| + | + | + | − | − | − | + | + |
| + | + | + | − | − | − | + | + |
| + | + | + | − | − | − | + | + |
| + | + | + | − | − | − | + | + |
| + | + | + | − | − | − | + | + |
| + | + | + | − | − | − | + | + |

| Frame-2 | | | | | | | |
|---|---|---|---|---|---|---|---|
| + | + | + | − | − | − | + | + |
| + | + | + | − | − | − | + | + |
| + | + | + | − | − | − | + | + |
| + | + | + | − | − | − | + | + |
| + | + | + | − | − | − | + | + |
| + | + | + | − | − | − | + | + |
| + | + | + | − | − | − | + | + |
| + | + | + | − | − | − | + | + |

FIG. 14

| Frame-1 | | | | | | | |
|---|---|---|---|---|---|---|---|
| + | − | − | + | − | + | + | − |
| + | − | − | + | − | + | + | − |
| + | − | − | + | − | + | + | − |
| + | − | − | + | − | + | + | − |
| + | − | − | + | − | + | + | − |
| + | − | − | + | − | + | + | − |
| + | − | − | + | − | + | + | − |
| + | − | − | + | − | + | + | − |

| Frame-2 | | | | | | | |
|---|---|---|---|---|---|---|---|
| + | − | − | + | − | + | + | − |
| + | − | − | + | − | + | + | − |
| + | − | − | + | − | + | + | − |
| + | − | − | + | − | + | + | − |
| + | − | − | + | − | + | + | − |
| + | − | − | + | − | + | + | − |
| + | − | − | + | − | + | + | − |
| + | − | − | + | − | + | + | − |

FIG. 15

| Frame-1 | | | | | | | |
|---|---|---|---|---|---|---|---|
| + | + | + | + | + | + | + | + |
| − | − | − | − | − | − | − | − |
| − | − | − | − | − | − | − | − |
| + | + | + | + | + | + | + | + |
| + | + | + | + | + | + | + | + |
| − | − | − | − | − | − | − | − |
| − | − | − | − | − | − | − | − |
| + | + | + | + | + | + | + | + |

| Frame-2 | | | | | | | |
|---|---|---|---|---|---|---|---|
| − | − | − | − | − | − | − | − |
| + | + | + | + | + | + | + | + |
| + | + | + | + | + | + | + | + |
| − | − | − | − | − | − | − | − |
| − | − | − | − | − | − | − | − |
| + | + | + | + | + | + | + | + |
| + | + | + | + | + | + | + | + |
| − | − | − | − | − | − | − | − |

FIG. 16

| Frame-1 | | | | | | | |
|---|---|---|---|---|---|---|---|
| + | + | + | − | − | − | + | + |
| − | − | − | + | + | + | − | − |
| + | + | + | − | − | − | + | + |
| − | − | − | + | + | + | − | − |
| + | + | + | − | − | − | + | + |
| − | − | − | + | + | + | − | − |
| + | + | + | − | − | − | + | + |
| − | − | − | + | + | + | − | − |

| Frame-2 | | | | | | | |
|---|---|---|---|---|---|---|---|
| − | − | − | + | + | + | − | − |
| + | + | + | − | − | − | + | + |
| − | − | − | + | + | + | − | − |
| + | + | + | − | − | − | + | + |
| − | − | − | + | + | + | − | − |
| + | + | + | − | − | − | + | + |
| − | − | − | + | + | + | − | − |
| + | + | + | − | − | − | + | + |

FIG. 17

| Frame-1 | | | | | | | |
|---|---|---|---|---|---|---|---|
| + | + | + | − | − | − | + | + |
| − | − | − | + | + | + | − | − |
| − | − | − | + | + | + | − | − |
| + | + | + | − | − | − | + | + |
| + | + | + | − | − | − | + | + |
| − | − | − | + | + | + | − | − |
| − | − | − | + | + | + | − | − |
| + | + | + | − | − | − | + | + |

| Frame-2 | | | | | | | |
|---|---|---|---|---|---|---|---|
| − | − | − | + | + | + | − | − |
| + | + | + | − | − | − | + | + |
| + | + | + | − | − | − | + | + |
| − | − | − | + | + | + | − | − |
| − | − | − | + | + | + | − | − |
| + | + | + | − | − | − | + | + |
| + | + | + | − | − | − | + | + |
| − | − | − | + | + | + | − | − |

FIG. 18

| Frame-1 | | | | | | | |
|---|---|---|---|---|---|---|---|
| + | − | − | + | − | + | + | − |
| − | + | + | − | + | − | − | + |
| − | + | + | − | + | − | − | + |
| + | − | − | + | − | + | + | − |
| + | − | − | + | − | + | + | − |
| − | + | + | − | + | − | − | + |
| − | + | + | − | + | − | − | + |
| + | − | − | + | − | + | + | − |

| Frame-2 | | | | | | | |
|---|---|---|---|---|---|---|---|
| − | + | + | − | + | − | − | + |
| + | − | − | + | − | + | + | − |
| + | − | − | + | − | + | + | − |
| − | + | + | − | + | − | − | + |
| − | + | + | − | + | − | − | + |
| + | − | − | + | − | + | + | − |
| + | − | − | + | − | + | + | − |
| − | + | + | − | + | − | − | + |

FIG. 19

| Frame-1 | | | | | | | |
|---|---|---|---|---|---|---|---|
| + | + | + | + | + | + | + | + |
| − | − | − | − | − | − | − | − |
| | | | | | | | |
| | | | | | | | |
| + | + | + | + | + | + | + | + |
| − | − | − | − | − | − | − | − |
| | | | | | | | |
| | | | | | | | |

FIG. 21

| Frame-1 | | | | | | | |
|---|---|---|---|---|---|---|---|
| + | | + | − | | − | + | |
| + | | + | − | | − | + | |
| + | | + | − | | − | + | |
| + | | + | − | | − | + | |
| + | | + | − | | − | + | |
| + | | + | − | | − | + | |
| + | | + | − | | − | + | |
| + | | + | − | | − | + | |

FIG. 22

SOURCE DRIVER AND OPERATION METHOD FOR IMPROVING DISPLAY QUALITY

CROSS-REFERENCE TO RELATED APPLICATION

This application claims the priority benefit of U.S. provisional application Ser. No. 62/618,590, filed on Jan. 17, 2018. The entirety of the above-mentioned patent application is hereby incorporated by reference herein and made a part of this specification.

BACKGROUND

Field of the Invention

The invention relates to a display apparatus and more particularly, to a source driver and an operation method thereof.

Description of Related Art

In order for a display apparatus to have color depths of higher levels, a source driver must be capable of processing more data bits. A differential difference amplifier (DDA) is usually applied in a source driver with capability of processing a great amount of data bits, so as to reduce a circuit area of a digital to analog converter (DAC) circuit.

FIG. 1 is a schematic circuit block diagram of a source driver 100. It is assumed herein that the source driver 100 is capable of processing gray-scale data (sub-pixel data) Din of 8 bits. The source driver 100 includes a level shifter 130, a DAC circuit 110 and a DDA 120. In the source driver 100, a part of bits of the gray-scale data Din (for example, 6 of the 8 bits) (digital codes D1) are provided to the DAC circuit 110 via the level shifter 130, and the other part of bits of the gray-scale data Din (for example, 2 of the 8 bits) (digital codes D2) are provided to the DDA 120 via the level shifter 130. The DAC circuit 110 may convert the data of 6 bits (the digital codes D1) of the gray-scale data Din into a corresponding high voltage VH and a corresponding low voltage VL.

A driving voltage Vout related to the gray-scale data Din may be interpolated between the corresponding high voltage VH and the corresponding low voltage VL by the DDA 120 according to the 2-bit data (the digital codes D2) of the gray-scale data Din. The driving voltage Vout is transmitted to a data line (a source line) of a display panel 10. When different digital codes D2 are input to the DDA 120, ideally, the driving voltage Vout output by the DDA 120 should have linearity. However, the interpolated voltage output by the DDA circuit is usually nonlinear. The nonlinearity of the interpolated voltage (the driving voltage Vout) output by the DDA 120 may easily result in a visually unsmooth gamma color level.

SUMMARY

The invention provides a source driver and an operation method thereof for improving display quality.

According to an embodiment of the invention, a source driver is provided. The source driver includes a chopper circuit and a source driver circuit. The chopper circuit is configured to receive a frame stream. The frame stream includes original gray-scale data of a first sub-pixel and original gray-scale data of a second sub-pixel. The first sub-pixel and the second sub-pixel are temporally or spatially adjacent to each other. The chopper circuit is further configured to add the original gray-scale data of the first sub-pixel with a first value to serve as new gray-scale data of the first sub-pixel and deduct the original gray-scale data of the second sub-pixel by a second value to serve as new gray-scale data of the second sub-pixel, wherein the first value and the second value are both positive values or both negative values. The source driver circuit is configured to receive the new gray-scale data of the first sub-pixel and the new gray-scale data of the second sub-pixel. The source driver circuit generates a first driving voltage for the first sub-pixel according to the new gray-scale data of the first sub-pixel, and generates a second driving voltage for the second sub-pixel according to the new gray-scale data of the second sub-pixel.

According to an embodiment of the invention, an operation method of a source driver is provided. The operation method includes: receiving a frame stream by a chopper circuit, wherein the frame stream includes original gray-scale data of a first sub-pixel and original gray-scale data of a second sub-pixel, and the first sub-pixel and the second sub-pixel are temporally or spatially adjacent to each other; adding the original gray-scale data of the first sub-pixel with a first value to serve as new gray-scale data of the first sub-pixel by the chopper circuit; deducting the original gray-scale data of the second sub-pixel by a second value to serve as new gray-scale data of the second sub-pixel by the chopper circuit, wherein the first value and the second value are both positive values or both negative values; generating a first driving voltage for the first sub-pixel according to the new gray-scale data of the first sub-pixel by the source driver circuit; and generating a second driving voltage for the second sub-pixel according to the new gray-scale data of the second sub-pixel by the source driver circuit.

To sum up, the source driver and the operation method provided by the embodiments of the invention can perform addition and deduction on two sets of gray-scale data that are temporally (and/or spatially) adjacent to each other, so as to offset the nonlinearity error caused by the source driver circuit. As for a visual effect, since the nonlinearity error can be effectively offset, the source driver can improve display quality for a panel.

To make the above features and advantages of the invention more comprehensible, embodiments accompanied with drawings are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 9 is a schematic diagram of two temporally adjacent frames according to an embodiment of the invention.

FIG. 10 is a schematic diagram of two temporally adjacent frames according to another embodiment of the invention.

FIG. 11 is a schematic diagram of two temporally adjacent frames according to another embodiment of the invention.

FIG. 12 is a schematic diagram of two temporally adjacent frames according to another embodiment of the invention.

FIG. 13 is a schematic diagram of two temporally adjacent frames according to another embodiment of the invention.

FIG. 14 is a schematic diagram of two temporally adjacent frames according to another embodiment of the invention.

FIG. 15 is a schematic diagram of two temporally adjacent frames according to another embodiment of the invention.

FIG. 16 is a schematic diagram of two temporally adjacent frames according to another embodiment of the invention.

FIG. 17, FIG. 18 and FIG. 19 are schematic diagrams of two temporally adjacent frames according to different embodiments of the invention.

FIG. 21 is a schematic diagram of different sub-pixels of one frame according to still another embodiment of the present invention.

FIG. 22 is a schematic diagram of different sub-pixels of one frame according to further another embodiment of the present invention.

DESCRIPTION OF EMBODIMENTS

Figure 1:
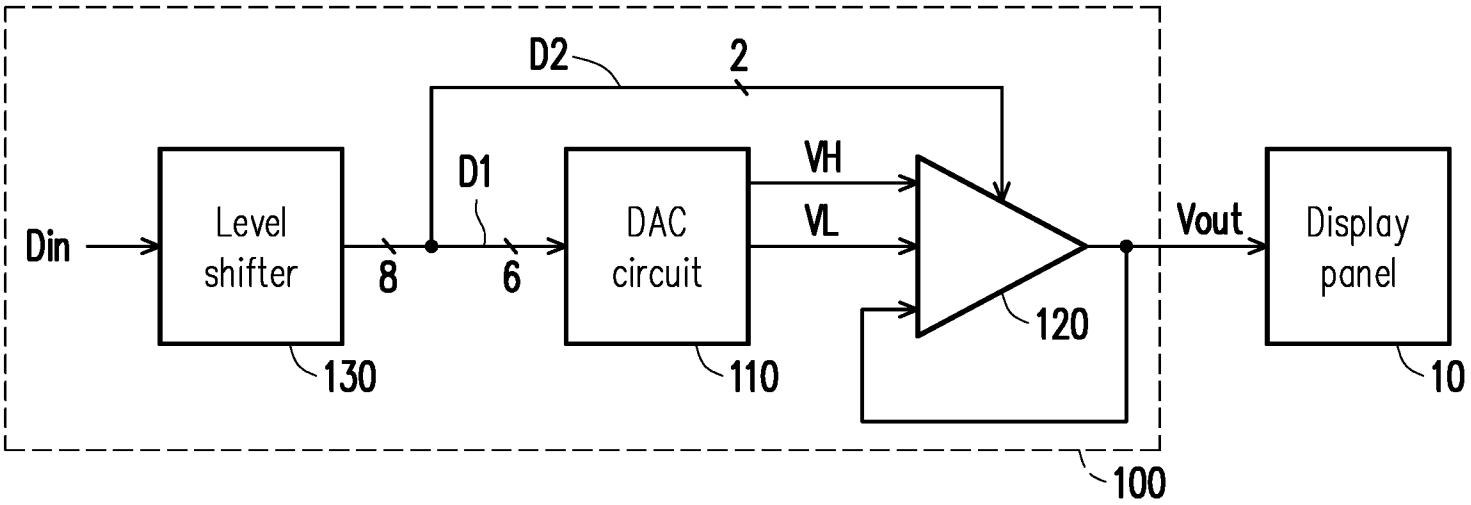
FIG. 1 (RELATED ART)
FIG. 1 is a schematic circuit block diagram of a source driver.

The term "couple (or connect)" herein (including the claims) are used broadly and encompass direct and indirect connection or coupling means. For example, if the disclosure describes a first apparatus being coupled (or connected) to a second apparatus, then it should be interpreted that the first apparatus can be directly connected to the second apparatus, or the first apparatus can be indirectly connected to the second apparatus through other devices or by a certain coupling means. Moreover, elements/components/steps with same reference numerals represent same or similar parts in the drawings and embodiments. Elements/components/notations with the same reference numerals in different embodiments may be referenced to the related description.

Figure 2:
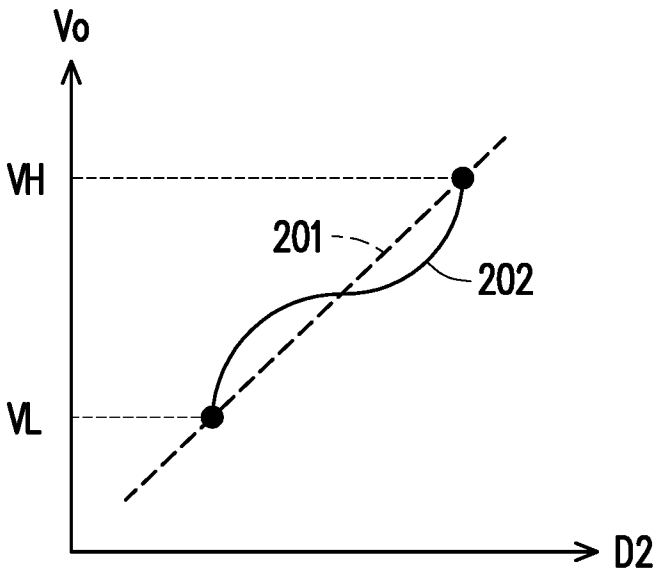
FIG. 2 is a schematic characteristic curve diagram of the driving voltage output by the differential difference amplifier depicted in FIG. 1.

FIG. 2 is a schematic characteristic curve diagram of a driving voltage output by a differential difference amplifier (DDA) such as the DDA 120 as depicted in FIG. 1. In FIG. 2, the horizontal axis represents the digital codes D2, and the vertical axis represents the driving voltage Vout output by the DDA 120. The driving voltage Vout related to the gray-scale data Din between the corresponding high voltage VH and the corresponding low voltage VL may be interpolated by the DDA 120 according to the digital codes D2. A characteristic curve 201 illustrated in FIG. 2 shows an ideal characteristic curve of the driving voltage Vout, and a characteristic curve 202 illustrated in FIG. 2 shows an actual characteristic curve of the driving voltage Vout. Ideally, the driving voltage Vout output by the DDA 120 should have linearity (as shown by the characteristic curve 201). However, the driving voltage Vout output by the DDA 120 usually has nonlinearity (as shown by the characteristic curve 202). The nonlinearity of the interpolated voltage (the driving voltage Vout) output by the DDA 120 may easily result in a visually unsmooth gamma color level.

Figure 3:
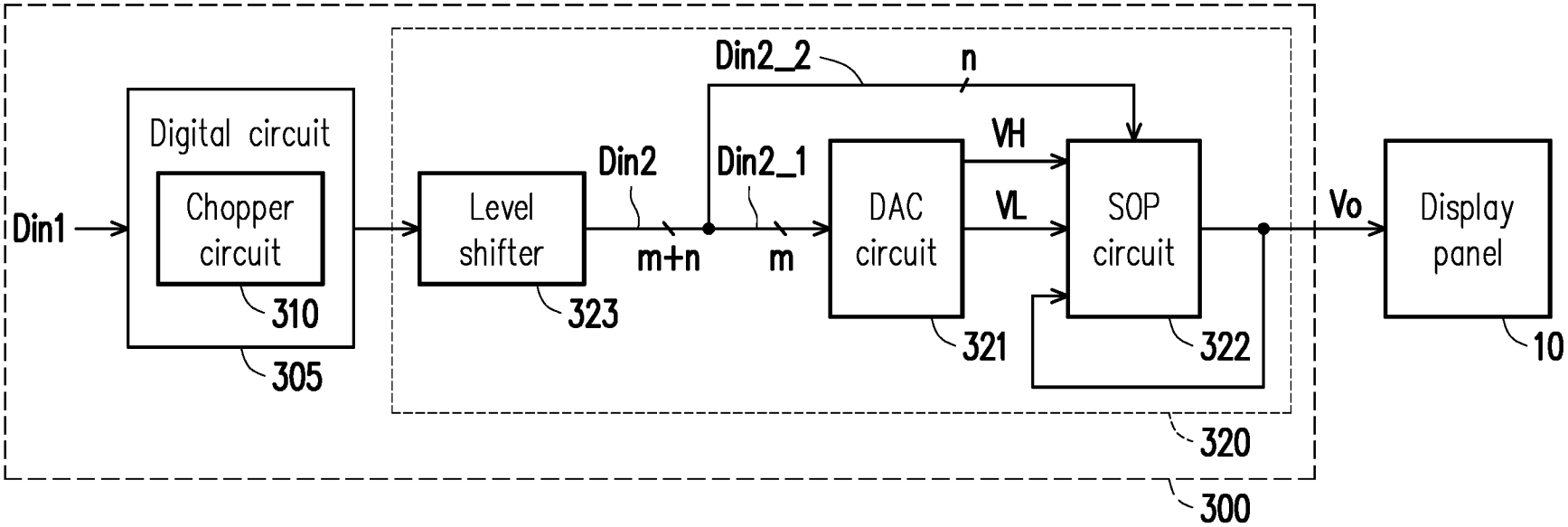
FIG. 3 is a schematic circuit block diagram of a source driver according to an embodiment of the invention.

FIG. 3 is a schematic circuit block diagram of a source driver 300 according to an embodiment of the invention. The source driver 300 illustrated in FIG. 3 includes a digital circuit 305 and a source driver circuit 320. The digital circuit 305 may include a chopper circuit 310 and other digital circuits as required, which means that the source driver circuit 320 may be directly or indirectly coupled to the chopper circuit 310. The chopper circuit 310 is configured to receive a frame stream Din1. The frame stream Din1 includes original gray-scale data of a first sub-pixel and original gray-scale data of a second sub-pixel, wherein the first sub-pixel and the second sub-pixel are temporally (and/or spatially) adjacent to each other. The term "adjacent" throughout the specification (including the claims) of the application may refer to directly adjacent or indirectly adjacent. For instance, in some embodiments, the first sub-pixel is temporally (and/or spatially) directly adjacent to the second sub-pixel, namely, temporally (and/or spatially), no other sub-pixels exist between the first sub-pixel and the second sub-pixel. In some other embodiments, the first sub-pixel is temporally (and/or spatially) indirectly adjacent to the second sub-pixel, namely, temporally (and/or spatially), at least one sub-pixel exists between the first sub-pixel and the second sub-pixel. For instance, one to three sub-pixels exist between the first sub-pixel and the second sub-pixel. For the one or three sub-pixels, the original gray-scale data can be served as new gray-scale data in the chopper circuit.

Figure 4:
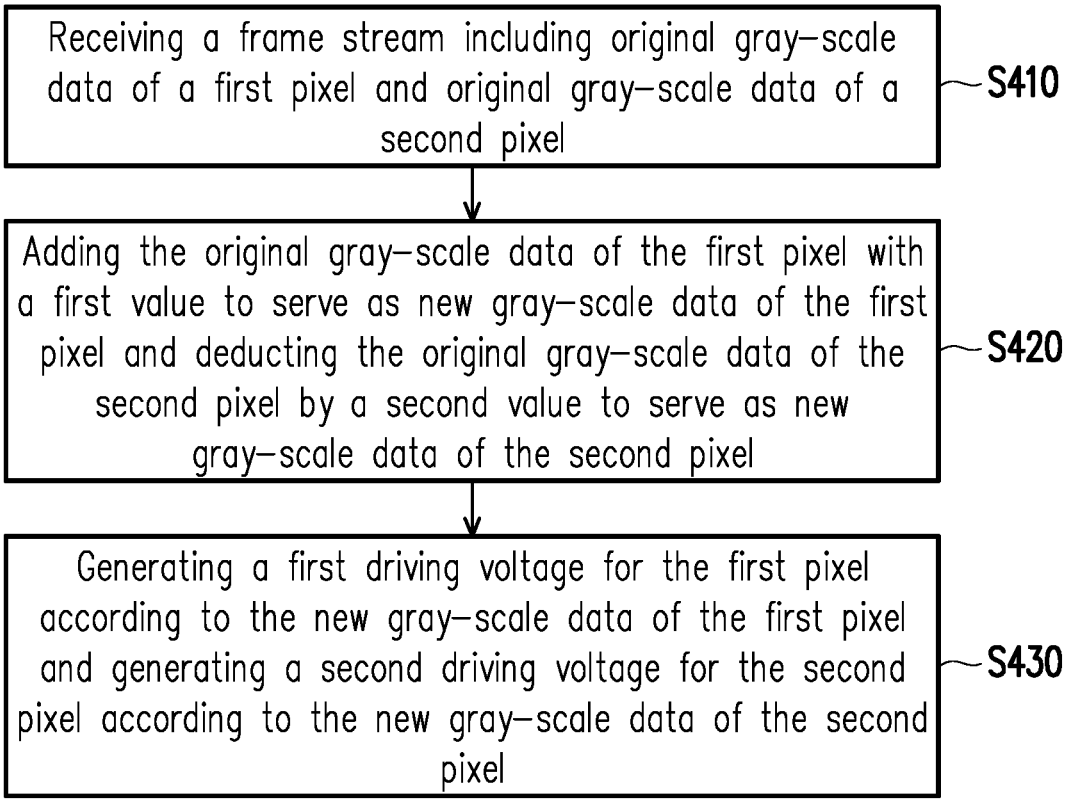
FIG. 4 is a flowchart of an operation method of a source driver according to an embodiment of the invention.

FIG. 4 is a flowchart of an operation method of a source driver according to an embodiment of the invention. Referring to FIG. 3 and FIG. 4, in step S410, the chopper circuit 310 receives the frame stream Din1. The frame stream Din1 includes original gray-scale data of a first sub-pixel and original gray-scale data of a second sub-pixel, wherein the first sub-pixel and the second sub-pixel are temporally (and/or spatially) adjacent to each other. The chopper circuit 310, in step S420, may process the frame stream Din1 to obtain a frame stream Din2. For instance, in step S420, the chopper circuit 310 may add the original gray-scale data of the first sub-pixel with a first value to serve as new gray-scale data of the first sub-pixel and deduct the original gray-scale data of the second sub-pixel by a second value to serve as new gray-scale data of the second sub-pixel. The first value and the second value may have the same sign, which means that they may be both positive values or both negative values. The first value and the second value may be determined based on a design requirement. The frame stream Din2 containing these new gray-scale data is transmitted to the source driver circuit 320.

In some embodiments, no matter whether the original gray-scale data of the first sub-pixel is identical to the original gray-scale data of the second sub-pixel, the chopper circuit 310, in step S420, may adjust the original gray-scale data of the first sub-pixel and the original gray-scale data of the second sub-pixel to obtain the new gray-scale data of the first sub-pixel and the new gray-scale data of the second sub-pixel.

In some other embodiments, the chopper circuit 340, in step S420, may check whether the original gray-scale data of the first sub-pixel is identical to the original gray-scale data of the second sub-pixel and determine whether to adjust the original gray-scale data of the first sub-pixel and the original gray-scale data of the second sub-pixel according to the checking result. When the original gray-scale data of the first sub-pixel is identical to the original gray-scale data of the second sub-pixel, the chopper circuit 310, in step S420, may adjust the original gray-scale data of the first sub-pixel and the original gray-scale data of the second sub-pixel to obtain the new gray-scale data of the first sub-pixel and the new gray-scale data of the second sub-pixel. When the original gray-scale data of the first sub-pixel is different from the original gray-scale data of the second sub-pixel, the chopper circuit 340, in step S420, may not adjust the original gray-scale data of the first sub-pixel and the original gray-scale data of the second sub-pixel, i.e., serve the original gray-scale data of the first sub-pixel as the new gray-scale data of the first sub-pixel and serve the original gray-scale data of the second sub-pixel as the new gray-scale data of the second sub-pixel.

In some embodiments, the first sub-pixel and the second sub-pixel are two sub-pixels that are temporally adjacent to each other. For instance, the first sub-pixel and the second sub-pixel are two sub-pixels that are located at the same position in a current frame and a previous frame, respectively.

For descriptive convenience, it is assumed that the first sub-pixel is in a first frame, the second sub-pixel is in a second frame, a third sub-pixel is in a third frame, and a fourth sub-pixel is in a fourth frame, wherein the first frame, the second frame, the third frame and the fourth frame are temporally adjacent to one another, and the first sub-pixel, the second sub-pixel, the third sub-pixel and the fourth sub-pixel spatially are at the same position. In some embodiments, the chopper circuit 310 may add the original gray-scale data of the first sub-pixel with the first value to serve as the new gray-scale data of the first sub-pixel, deduct the original gray-scale data of the second sub-pixel by the second value to serve as the new gray-scale data of the second sub-pixel, add original gray-scale data of the third sub-pixel with a third value to serve as new gray-scale data of the third sub-pixel and deduct original gray-scale data of the fourth sub-pixel by a fourth value to serve as new gray-scale data of the fourth sub-pixel. The first value, the second value, the third value and the fourth value may be all positive values or all negative values. Furthermore, the first value, the second value, the third value and the fourth value may be determined based on a design requirement. Namely, original gray-scale data of a plurality of sub-pixels spatially located at the same position in a plurality of frames can be adjusted according to a rule of "addition, deduction, addition, deduction, . . . " to serve as new gray-scale data. In some other embodiments, the chopper circuit 310 may add the original gray-scale data of the first sub-pixel with the first value to serve as the new gray-scale data of the first sub-pixel, deduct the original gray-scale data of the second sub-pixel by the second value to serve as the new gray-scale data of the second sub-pixel, deduct the original gray-scale data of the third sub-pixel by the third value to serve as the new gray-scale data of the third sub-pixel and add the original gray-scale data of the fourth sub-pixel with the fourth value to serve as the new gray-scale data of the fourth sub-pixel. Namely, original gray-scale data of a plurality of sub-pixels spatially having the same position is adjusted according to a rule of "addition, deduction, deduction, addition, addition, deduction, deduction, addition, . . . " to serve as new gray-scale data.

In some other embodiments, the first sub-pixel and the second sub-pixel are two sub-pixels that are spatially adjacent to each other. For instance, the first sub-pixel and the second sub-pixel are two sub-pixels that are located at adjacent positions in the same frame.

For descriptive convenience, it is assumed that the first sub-pixel and the second sub-pixel are located in the a frame and spatially adjacent to each other, and the third sub-pixel and the fourth sub-pixel are located in a second frame, wherein the first frame and the second frame are temporally adjacent to each other, the first sub-pixel and the third sub-pixel spatially have the same position, and the second sub-pixel and the fourth sub-pixel spatially have the same position. In some embodiments, the chopper circuit 310 may add the original gray-scale data of the first sub-pixel with the first value to serve as the new gray-scale data of the first sub-pixel, deduct the original gray-scale data of the second sub-pixel by the second value to serve as the new gray-scale data of the second sub-pixel, add the original gray-scale data of the third sub-pixel with the third value to serve as the new gray-scale data of the third sub-pixel and deduct the original gray-scale data of the fourth sub-pixel by the fourth value to serve as the new gray-scale data of the fourth sub-pixel, wherein the first value, the second value, the third value and the fourth value are all positive values, and the first value, the second value, the third value and the fourth value may be determined based on a design requirement. Namely, for two sub-pixels that are spatially adjacent to each other, if one of the sub-pixels keeps being adjusted by "addition" in different times, the other one of the sub-pixels keeps being adjusted by "deduction" in different times, so as to obtain new gray-scale data. In some other embodiments, the chopper circuit 310 may add the original gray-scale data of the first sub-pixel with the first value to serve as the new gray-scale data of the first sub-pixel, deduct the original gray-scale data of the second sub-pixel by the second value to serve as the new gray-scale data of the second sub-pixel, deduct the original gray-scale data of the third sub-pixel by the third value to serve as the new gray-scale data of the third sub-pixel and add the original gray-scale data of the fourth sub-pixel with the fourth value to serve as the new gray-scale data of the fourth sub-pixel. Namely, for two sub-pixels that are spatially adjacent to each other, if one of the sub-pixels keeps being adjusted according to a rule of "addition, deduction, addition, deduction, . . . " in different times, the other one of the sub-pixels keeps being adjusted according to a rule of "deduction, addition, deduction, addition, . . . " in different times, so as to obtain new gray-scale data.

Based on a design requirement, in some embodiments, the first value, the second value, the third value and the fourth value may be identical to one another. In some other embodiments, the first value, the second value, the third value and the fourth value may be different from one another. For instance, the first value may be not equal to the second value.

The source driver circuit 320 is coupled to an output terminal of the chopper circuit 310, so as to receive the frame stream Din2. After the source driver circuit 320 receives the new gray-scale data of the first sub-pixel and the new gray-scale data of the second sub-pixel, the source driver circuit 320, in step S430, may generate a first driving voltage for the first sub-pixel according to the new gray-scale data of the first sub-pixel and generate a second driving voltage for the second sub-pixel according to the new gray-scale data of the second sub-pixel.

The implementation manner of the source driver circuit 320 is not limited in the present embodiment. For example (but not limited to), the source driver 320 illustrated in FIG. 3 includes a level shifter 323, a digital to analog converter (DAC) circuit 321 and a source operational amplifier (SOP) circuit 322. The DAC circuit 321 may convert a first portion of bits Din2_1 of the new gray-scale data of the first sub-pixel into a corresponding high voltage VH and a corresponding low voltage VL.

For example, Table 1 is a table presenting the relationship between the input and the output of the DAC circuit 321. In the example of Table 1, it is assumed that the number of the new gray-scale data output by the chopper circuit 310 and the level shifter 323 is 3+2=5-bit, i.e., m is 3 and n is 2. The DAC circuit 321 may convert a first bits "000" into a first high voltage (e.g., V0) and a first low voltage (e.g., V1). The DAC circuit 321 may also convert a second bits into a second high voltage (e.g., V1) and a second low voltage (e.g., V2). The high voltage VH and the low voltage VL in Table 1 may be determined based on a design requirement. For instance, in some embodiments, V0 is 6 V, V1 is 5.6 V, V2 is 5.2 V, V3 is 4.8 V, V4 is 4.4 V, V5 is 4 V, V6 is 3.6 V, V7 is 3.2 V, and V8 is 2.8 V.

TABLE 1 relationship between the input and the output of the DAC circuit 321

| bits Din2_1 | | | VH | VL |
|---|---|---|---|---|
| 0 | 0 | 0 | V0 | V1 |
| 0 | 0 | 1 | V1 | V2 |
| 0 | 1 | 0 | V2 | V3 |
| 0 | 1 | 1 | V3 | V4 |
| 1 | 0 | 0 | V4 | V5 |
| 1 | 0 | 1 | V5 | V6 |
| 1 | 1 | 0 | V6 | V7 |
| 1 | 1 | 1 | V7 | V8 |

The SOP circuit 322 is coupled to the DAC circuit 321 to receive the high voltage VH and the low voltage VL. The SOP circuit 322 obtains a first driving voltage for the first sub-pixel according to the first high voltage (e.g., V0) and the first low voltage (e.g., V1), thereby driving a display panel 10. The SOP circuit 322 obtains a second driving voltage for the second sub-pixel according to the second high voltage (e.g., V1) and the second low voltage (e.g., V2), thereby driving the display panel 10. For instance, the SOP circuit 322 may generate the first driving voltage by interpolating the first high voltage (e.g., V0) and the first low voltage (e.g., V1) according to a second portion of bits Din2_2 of the new gray-scale data of the first sub-pixel. The SOP circuit 322 may generate the second driving voltage by interpolating the second high voltage (e.g., V1) and the second low voltage (e.g., V2) according to a second portion of bits Din2_2 of the new gray-scale data of the second sub-pixel.

For example, Table 2 is a table presenting the relationship between the input and the output of the SOP circuit 322. In the example of Table 2, it is assumed that the number of the new gray-scale data output by the chopper circuit 310 and the level shifter 323 is 3+2=5-bit, i.e., m is 3 and n is 2. The SOP circuit 322 may generate the driving voltage by interpolating the high voltage VH and the low voltage VL in Table 1 according to the bits Din2_2. The voltages listed in Table 2 are ideal linear voltages and do not include SOP Interpolation Non-linear Error.

TABLE 2 relationship between the input and the output of the DAC circuit 321

| bits Din2_1 | Din2_2 | Interpolation Formula | Output (V) |
|---|---|---|---|
| 000 | 00 | (4/4)V0 + (0/4)V1 | 6 |
| | 01 | (3/4)V0 + (1/4)V1 | 5.9 |
| | 10 | (2/4)V0 + (2/4)V1 | 5.8 |
| | 11 | (1/4)V0 + (3/4)V1 | 5.7 |
| 001 | 00 | (4/4)V1 + (0/4)V2 | 5.6 |
| | 01 | (3/4)V1 + (1/4)V2 | 5.5 |
| | 10 | (2/4)V1 + (2/4)V2 | 5.4 |
| | 11 | (1/4)V1 + (3/4)V2 | 5.3 |
| 010 | 00 | (4/4)V2 + (0/4)V3 | 5.2 |
| | 01 | (3/4)V2 + (1/4)V3 | 5.1 |
| | 10 | (2/4)V2 + (2/4)V3 | 5 |
| | 11 | (1/4)V2 + (3/4)V3 | 4.9 |
| 011 | 00 | (4/4)V3 + (0/4)V4 | 4.8 |
| | 01 | (3/4)V3 + (1/4)V4 | 4.7 |
| | 10 | (2/4)V3 + (2/4)V4 | 4.6 |
| | 11 | (1/4)V3 + (3/4)V4 | 4.5 |
| 100 | 00 | (4/4)V4 + (0/4)V5 | 4.4 |
| | 01 | (3/4)V4 + (1/4)V5 | 4.3 |
| | 10 | (2/4)V4 + (2/4)V5 | 4.2 |
| | 11 | (1/4)V4 + (3/4)V5 | 4.1 |
| 101 | 00 | (4/4)V5 + (0/4)V6 | 4 |
| | 01 | (3/4)V5 + (1/4)V6 | 3.9 |
| | 10 | (2/4)V5 + (2/4)V6 | 3.8 |
| | 11 | (1/4)V5 + (3/4)V6 | 3.7 |
| 110 | 00 | (4/4)V6 + (0/4)V7 | 3.6 |
| | 01 | (3/4)V6 + (1/4)V7 | 3.5 |
| | 10 | (2/4)V6 + (2/4)V7 | 3.4 |
| | 11 | (1/4)V6 + (3/4)V7 | 3.3 |
| 111 | 00 | (4/4)V7 + (0/4)V8 | 3.2 |
| | 01 | (3/4)V7 + (1/4)V8 | 3.1 |
| | 10 | (2/4)V7 + (2/4)V8 | 3 |
| | 11 | (1/4)V7 + (3/4)V8 | 2.9 |

The implementation manner of the SOP circuit 322 is not limited in the present embodiment. For instance, in some embodiments, the SOP circuit 322 includes a differential difference amplifier (DDA) or any other amplifier circuit.

The number of bits of the "first portion of bits Din2_1" and the number of the "second portion of bits Din2_2" may be determined based on a design requirement. For instance, in some embodiments, it is assumed that the number of the new gray-scale data output by the chopper circuit 310 is m+n, m and n are integers, the number of the "first portion of bits Din2_1" may be m, and the number of the "second portion of bits Din2_2" may be n.

The first value, the second value, the third value and the fourth value are not particularly limited in the present embodiment. For example (but not limited to), when the number of the "second portion of bits Din2_2" is n, the first value, the second value, the third value and/or the fourth value are $2^{(n-2)}$. In case the number of the "second portion of bits Din2_2" is 2, the chopper circuit 310 may add the original gray-scale data of the first sub-pixel with $2^{(2-2)}=1$ (i.e., the first value) to serve as the new gray-scale data of the first sub-pixel and deduct the original gray-scale data of the second sub-pixel by 1 (i.e., the second value) to serve as the new gray-scale data of the second sub-pixel. In case the number of the "second portion of bits Din2_2" is 3, the chopper circuit 310 may add the original gray-scale data of the first sub-pixel with $2^{(3-2)}=2$ (i.e., the first value) to serve as the new gray-scale data of the first sub-pixel and deduct the original gray-scale data of the second sub-pixel by 2 (i.e., the second value) to serve as the new gray-scale data of the second sub-pixel.

Figure 5:
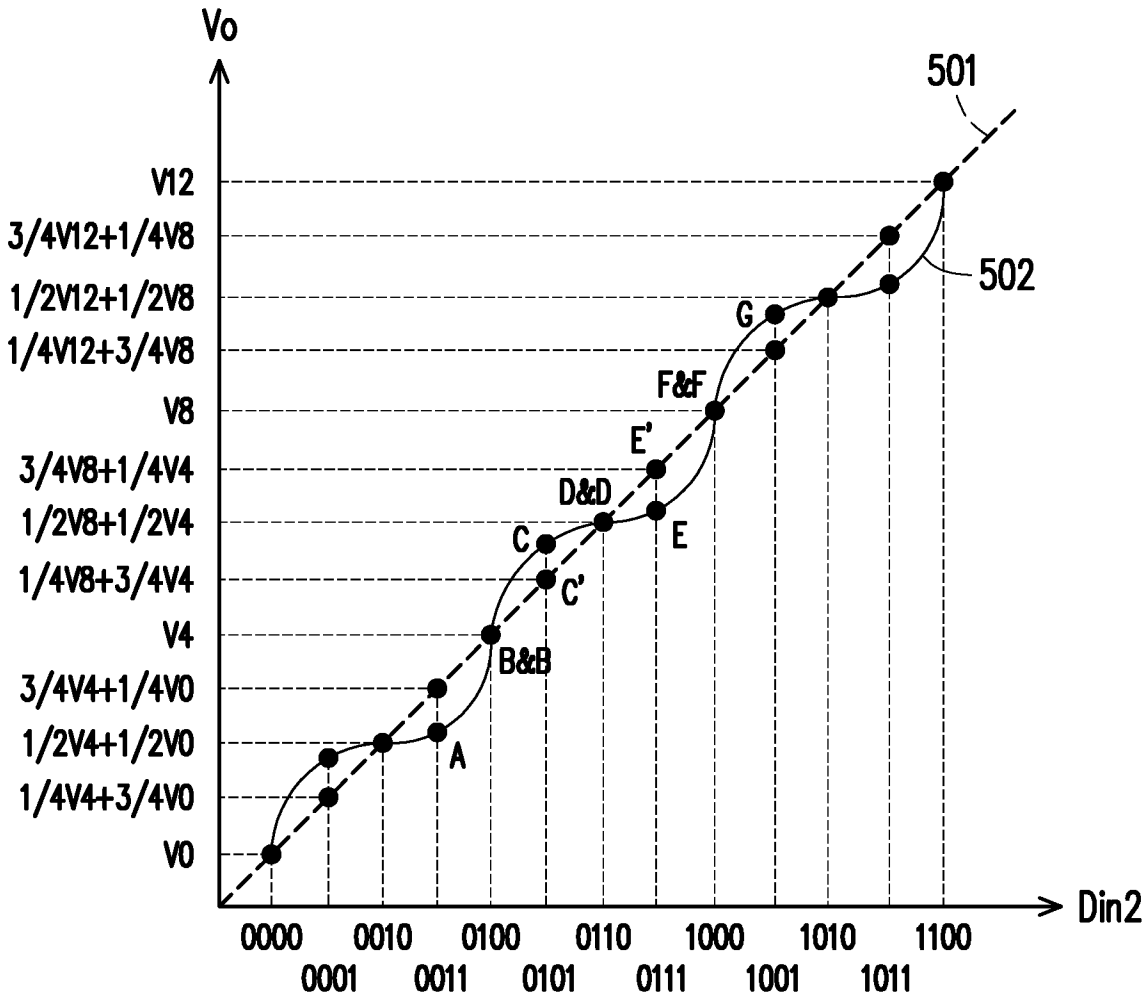
FIG. 5 is a schematic characteristic curve diagram of a driving voltage output by the source operational amplifier circuit depicted in FIG. 3.

FIG. 5 is a schematic characteristic curve diagram of a driving voltage Vo output by the SOP circuit 322 depicted in FIG. 3. In FIG. 5, the horizontal axis represents the new gray-scale data in the frame stream Din2, and the vertical axis represents the driving voltage Vo output by the SOP circuit 322. A characteristic curve 501 illustrated in FIG. 5 shows an ideal characteristic curve of the driving voltage Vo, and a characteristic curve 502 illustrated in FIG. 5 shows an actual characteristic curve of the driving voltage Vo.

For descriptive convenience, in the embodiment illustrated in FIG. 5, the number of the new gray-scale data output by the chopper circuit 310 is assumed as 4, the number of the "first portion of bits Din2_1" is assumed as 2, and the number of the "second portion of bits Din2_2" is assumed as 2. When the "first portion of bits Din2_1" of the new gray-scale data in the frame stream Din2 is "00", the DAC circuit 321 may convert "00" into a voltage V4 (i.e., a high voltage) and a voltage V0 (i.e., a low voltage) to provide to the SOP circuit 322. The driving voltage Vo may be interpolated within a range between the voltage V4 and the voltage V0 by the SOP circuit 322 according to the "second portion of bits Din2_2". Ideally, when the new gray-scale data in the frame stream Din2 is "0000", "0001", "0010" or "0011", the driving voltage Vo is V0, (¼)V4+(¾)V0, (½)V4+(½)V0 or (¾)V4+(¼)V0, respectively.

To deduce by analogy, when the new gray-scale data in the frame stream Din2 is "0100", "0101", "0110" or "0111", the DAC circuit 321 may convert "01" into a voltage V8 (i.e., a high voltage) and the voltage V4 (i.e., a low voltage) to provide to the SOP circuit 322, and the driving voltage Vo output by the SOP circuit 322 is ideally V4, (¼)V8+(¾)V4, (½)V8+(½)V4 or (¾)V8+(¼)V4, respectively. When the new gray-scale data in the frame stream Din2 is "1000", "1001", "1010" or "1011", the DAC circuit 321 may convert "10" into a voltage V12 (i.e., a high voltage) and the voltage V8 (i.e., a low voltage) to provide to the SOP circuit 322, and the driving voltage Vo output by the SOP circuit 322 is ideally V8, (¼)V12+(¾)V8, (½)V12+(½)V8 or (¾)V12+(¼)V8, respectively. Namely, ideally, the driving voltage Vo output by the SOP circuit 322 should have linearity (as shown by the characteristic curve 501).

However, the driving voltage Vo output by the SOP circuit 322 is usually nonlinear (as shown by the characteristic curve 502). In the present embodiment, the nonlinearity error resulted from the SOP circuit 322 may be offset by the new gray-scale data of two sub-pixels that are temporally (or spatially) adjacent to each other. The description is provided as follows.

Points A, B, C, D, E, F and G illustrated in FIG. 5 respectively represent actual voltage levels of the driving voltage Vo output by the SOP circuit 322 when the new gray-scale data in the frame stream Din2 are "0011", "0100", "0101", "0110", "0111", "1000" and "1001". In case the point B is replaced by an average voltage (which is represented by a point B' illustrated in FIG. 5) of the points A and C, the point B' is quite close to an ideal voltage level of the new gray-scale data "0100". In case the point C is replaced by an average voltage (which is represented by a point C' illustrated in FIG. 5) of the points B and D, the point C' is quite close to an ideal voltage level of the new gray-scale data "0101". In case the point D is replaced by an average voltage (which is represented by a point D' illustrated in FIG. 5) of the points C and E, the point D' is quite close to an ideal voltage level of the new gray-scale data "0110". In case the point E is replaced by an average voltage (which is represented by a point E' illustrated in FIG. 5) of the points D and F, the point E' is quite close to an ideal voltage level of the new gray-scale data "0111". In case the point F is replaced by an average voltage (which is represented by a point F' illustrated in FIG. 5) of the points E and G, the point F is quite close to an ideal voltage level of the new gray-scale data "1000". According the calculation of the points B', C', D', E' and F', by temporally (or spatially) averaging the gray-scale data of two sub-pixels, the nonlinearity error of the SOP circuit 322 may be indeed effectively offset/reduced.

Figure 6:
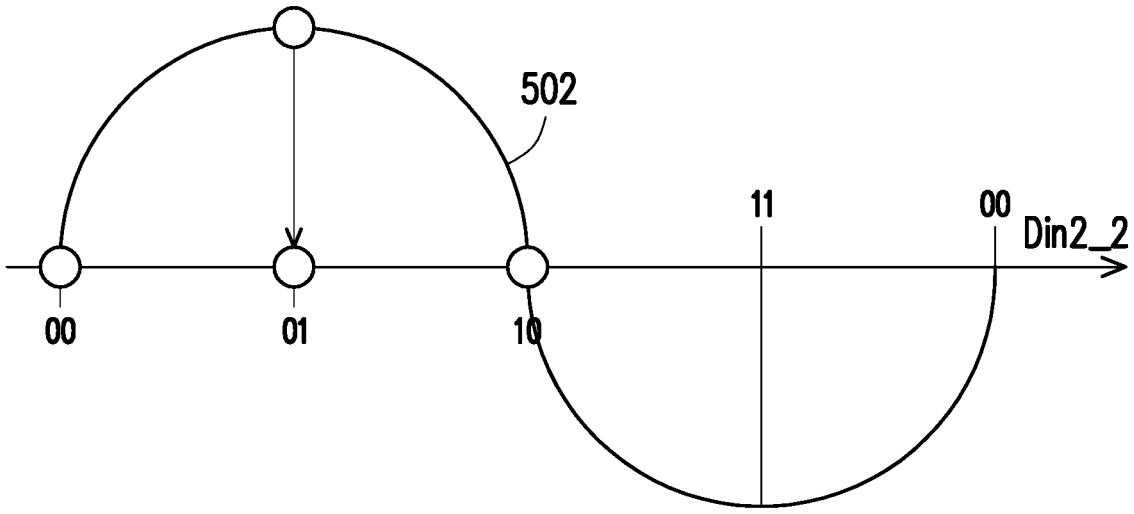
FIG. 6 is a schematic diagram of the second portion of bits of the new gray-scale data in the frame stream and an actual characteristic curve according to an embodiment of the invention.

FIG. 6 is a schematic diagram of the "second portion of bits Din2_2" of the new gray-scale data in the frame stream Din2 and an actual characteristic curve 502 according to an embodiment of the invention. In FIG. 6, the horizontal axis represents the "second portion of bits Din2_2" of the new gray-scale data in the frame stream Din2, and the vertical axis represents the driving voltage Vo output by the SOP circuit 322. In the embodiment illustrated in FIG. 6, the number of the "second portion of bits Din2_2" of the new gray-scale data output by the chopper circuit 310 is assumed as 2. The characteristic curve 502 illustrated in FIG. 6 may be a changed form of the actual characteristic curve 502 illustrated in FIG. 5. When the second portion of bits Din2_2 of the gray-scale data of each of the first sub-pixel and the second sub-pixel that are temporally (or spatially) adjacent to each other is "01", the chopper circuit 310 may add the original gray-scale data of the first sub-pixel with 1 (i.e., the first value) and deduct the original gray-scale data of the second sub-pixel by 1 (i.e., the second value). Thus, the second portion of bits Din2_2 of the new gray-scale data of the first sub-pixel is changed to "10", the second portion of bits Din2_2 of the new gray-scale data of the second sub-pixel is changed to "00". With visual characteristics of human eyes, the values of "10" and "00" may be temporally (or spatially) averaged, such that a gray scale of the original bit data "01" on the display panel is quite close to an ideal gray scale.

Figure 7:
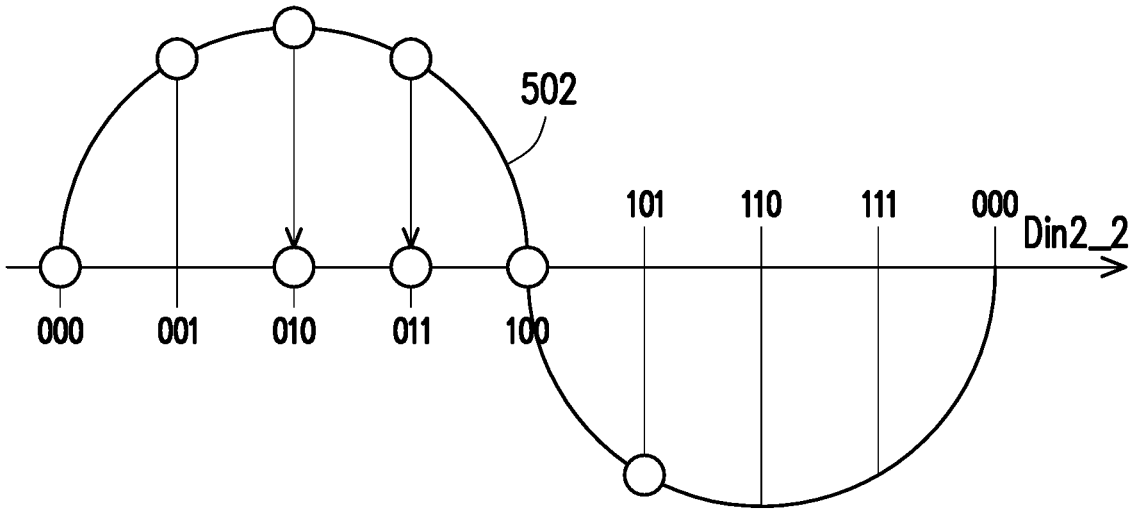
FIG. 7 is a schematic diagram of the second portion of bits of the new gray-scale data in the frame stream and an actual characteristic curve according to another embodiment of the invention.

FIG. 7 is a schematic diagram of the "second portion of bits Din2_2" of the new gray-scale data in the frame stream Din2 and an actual characteristic curve 502 according to another embodiment of the invention. In FIG. 7, the horizontal axis represents the "second portion of bits Din2_2" of the new gray-scale data in the frame stream Din2, and the vertical axis represents the driving voltage Vo output by the SOP circuit 322. In the embodiment illustrated in FIG. 7, the number of the "second portion of bits Din2_2" of the new gray-scale data output by the chopper circuit 310 is assumed as 3. The characteristic curve 502 illustrated in FIG. 7 may be a changed form of the actual characteristic curve 502 illustrated in FIG. 5.

When the second portion of bits Din2_2 of the gray-scale data of each of the first sub-pixel and the second sub-pixel that are temporally (or spatially) adjacent to each other is "010", the chopper circuit 310 may add the original gray-scale data of the first sub-pixel with 2 (i.e., the first value) and deduct the original gray-scale data of the second sub-pixel by 2 (i.e., the second value). Thus, the second portion of bits Din2_2 of the new gray-scale data of the first sub-pixel is changed to "100", the second portion of bits Din2_2 of the new gray-scale data of the second sub-pixel is changed to "000". With the visual characteristics of human eyes, the values of "100" and "000" may be temporally (or spatially) averaged, such that a gray scale of the original bit data "010" on the display panel is quite close to an ideal gray scale.

When the second portion of bits Din2_2 of the gray-scale data of each of the first sub-pixel and the second sub-pixel that are temporally (or spatially) adjacent to each other is "011", the chopper circuit 310 may add the original gray-scale data of the first sub-pixel with 2 (i.e., the first value) and deduct the original gray-scale data of the second sub-pixel by 2 (i.e., the second value). Thus, the second portion of bits Din2_2 of the new gray-scale data of the first sub-pixel is changed to "101", the second portion of bits Din2_2 of the new gray-scale data of the second sub-pixel is changed to "001". With the visual characteristics of human eyes, the values of "101" and "001" may be temporally (or spatially) averaged, such that a gray scale of the original bit data "011" on the display panel is quite close to an ideal gray scale.

Figure 8:
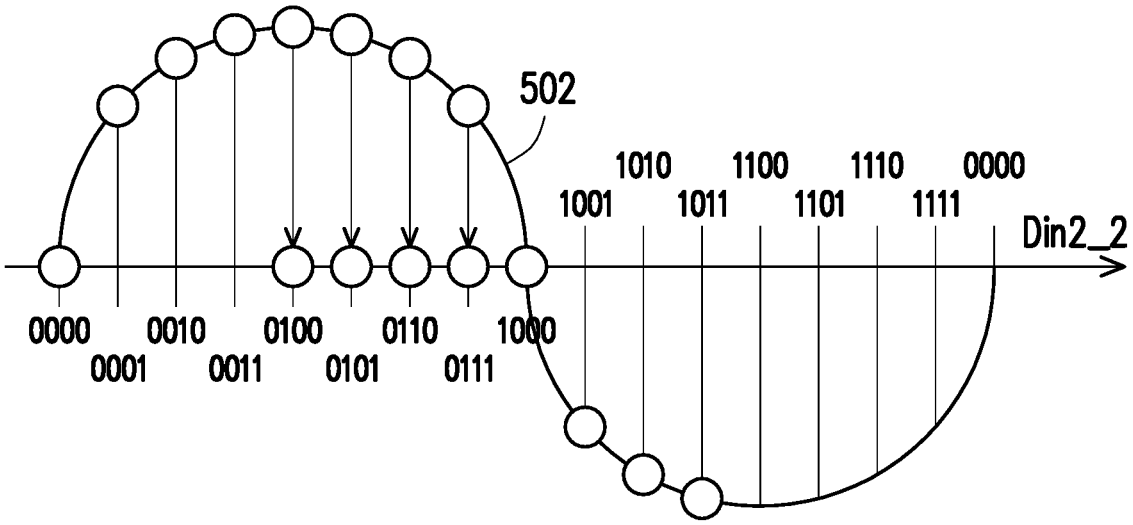
FIG. 8 is a schematic diagram of the second portion of bits of the new gray-scale data in the frame stream and an actual characteristic curve according to yet another embodiment of the invention.

FIG. 8 is a schematic diagram of the "second portion of bits Din2_2" of the new gray-scale data in the frame stream Din2 and an actual characteristic curve 502 according to yet another embodiment of the invention. In FIG. 8, the horizontal axis represents the "second portion of bits Din2_2" of the new gray-scale data in the frame stream Din2, and the vertical axis represents the driving voltage Vo output by the SOP circuit 322. In the embodiment illustrated in FIG. 8, the number of the "second portion of bits Din2_2" of the new gray-scale data output by the chopper circuit 310 is assumed as 4. The characteristic curve 502 illustrated in FIG. 8 may be a changed form of the actual characteristic curve 502 illustrated in FIG. 5.

When the second portion of bits Din2_2 of the gray-scale data of each of the first sub-pixel and the second sub-pixel that are temporally (or spatially) adjacent to each other is "0100", the chopper circuit 310 may add the original gray-scale data of the first sub-pixel with 4 (i.e., the first value) and deduct the original gray-scale data of the second sub-pixel by 4 (i.e., the second value). Thus, the second portion of bits Din2_2 of the new gray-scale data of the first sub-pixel is changed to "1000", the second portion of bits Din2_2 of the new gray-scale data of the second sub-pixel is changed to "0000". With the visual characteristics of human eyes, the values of "1000" and "0000" may be temporally (or spatially) averaged, such that a gray scale of the original bit data "0100" on the display panel is quite close to an ideal gray scale.

When the second portion of bits Din2_2 of the gray-scale data of each of the first sub-pixel and the second sub-pixel that are temporally (or spatially) adjacent to each other is "0101", the chopper circuit 310 may add the original gray-scale data of the first sub-pixel with 4 (i.e., the first value) and deduct the original gray-scale data of the second sub-pixel by 4 (i.e., the second value). Thus, the second portion of bits Din2_2 of the new gray-scale data of the first sub-pixel is changed to "1001", the second portion of bits Din2_2 of the new gray-scale data of the second sub-pixel is changed to "0001". With the visual characteristics of human eyes, the values of "1001" and "0001" may be temporally (or spatially) averaged, such that a gray scale of the original bit data "0101" on the display panel is quite close to an ideal gray scale.

FIG. 9 is a schematic diagram of two temporally adjacent frames according to an embodiment of the invention. FIG. 9 illustrates a first frame Frame-1 and a second frame Frame-2 that are temporally adjacent to each other. Each box illustrated in FIG. 9 represents a sub-pixel. In FIG. 9, a mark "+" indicates gray-scale data of the sub-pixel being added with a first value, and a mark "−" indicates gray-scale data of the sub-pixel being deducted by a second value. In the embodiment illustrated in FIG. 9, the chopper circuit 310 may add original gray-scale data of each of all sub-pixels in the first frame Frame-1 with the first value to serve as new gray-scale data of each of the sub-pixels in the first frame Frame-1 and deduct original gray-scale data of each of all sub-pixels in the second frame Frame-2 by the second value to serve as new gray-scale data of each of the sub-pixels in the second frame Frame-2.

FIG. 10 is a schematic diagram of two temporally adjacent frames according to another embodiment of the invention. FIG. 10 illustrates a first frame Frame-1 and a second frame Frame-2 that are temporally adjacent to each other. Each box illustrated in FIG. 10 represents a sub-pixel. In FIG. 10, a mark "+" indicates gray-scale data of the sub-pixel being added with a first value, and a mark "−" indicates gray-scale data of the sub-pixel being deducted by a second value. The chopper circuit 310 may add original gray-scale data of each of all sub-pixels of one of each odd row and each even row in the same frame with the first value and deduct original gray-scale data of each of all sub-pixels of the other one of each odd row and each even row in the same frame by the second value. For instance, in the embodiment illustrated in FIG. 10, the chopper circuit 310 may add the original gray-scale data of each of all sub-pixels of each odd row in the first frame Frame-1 (or the second frame Frame-2) with the first value and deduct the original gray-scale data of each of all sub-pixels of each even row in the first frame Frame-1 (or the second frame Frame-2) by the second value.

FIG. 11 is a schematic diagram of two temporally adjacent frames according to another embodiment of the invention. FIG. 11 illustrates a first frame Frame-1 and a second frame Frame-2 that are temporally adjacent to each other. Each box illustrated in FIG. 11 represents a sub-pixel. In FIG. 11, a mark "+" indicates gray-scale data of the sub-pixel being added with a first value, and a mark "−" indicates gray-scale data of the sub-pixel being deducted by a second value. The chopper circuit 310 may add original gray-scale data of each of all sub-pixels of a $(4i-3)^{th}$ row and a $(4i-2)^{th}$ row in the same frame with the first value and deduct original gray-scale data of each of all sub-pixels of a $(4i-1)^{th}$ row and a $(4i)^{th}$ row in the same frame by the second value, wherein i is a positive integer. For example, in the embodiment illustrated in FIG. 11, the chopper circuit 310 may add original gray-scale data of each of all sub-pixels of a $1^{st}$, a $2^{nd}$, a $5^{th}$ and a $6^{th}$ rows in the first frame Frame-1 (or the second frame Frame-2) with the first value and deduct original gray-scale data of each of all sub-pixels of a $3^{rd}$, a $4^{th}$, a $7^{th}$ and a $8^{th}$ rows in the first frame Frame-1 (or the second frame Frame-2) by the second value.

FIG. 12 is a schematic diagram of two temporally adjacent frames according to another embodiment of the invention. FIG. 12 illustrates a first frame Frame-1 and a second frame Frame-2 that are temporally adjacent to each other. Each box illustrated in FIG. 12 represents a sub-pixel. In FIG. 12, a mark "+" indicates gray-scale data of the sub-pixel being added with a first value, and a mark "−" indicates gray-scale data of the sub-pixel being deducted by a second value. The chopper circuit 310 may add original gray-scale data of each of all sub-pixels of a $(4i-3)^{th}$ row and a $(4i)^{th}$ row in the same frame with the first value and deduct original gray-scale data of each of all sub-pixels of a $(4i-1)^{th}$ row and a $(4i-2)^{th}$ row in the same frame by the second value, wherein i is a positive integer. For example, in the embodiment illustrated in FIG. 12, the chopper circuit 310 may add original gray-scale data of each of all sub-pixels of a $1^{st}$, a $4^{th}$, a $5^{th}$ and a $8^{th}$ rows in the first frame Frame-1 (or the second frame Frame-2) with the first value and deduct original gray-scale data of each of all sub-pixels of a $2^{nd}$, $3^{rd}$, a $6^{th}$ and a $7^{th}$ rows in the first frame Frame-1 (or the second frame Frame-2) by the second value.

FIG. 13 is a schematic diagram of two temporally adjacent frames according to another embodiment of the invention. FIG. 13 illustrates a first frame Frame-1 and a second frame Frame-2 that are temporally adjacent to each other. Each box illustrated in FIG. 13 represents a sub-pixel. In FIG. 13, a mark "+" indicates gray-scale data of the sub-pixel being added with a first value, and a mark "−" indicates gray-scale data of the sub-pixel being deducted by a second value. The chopper circuit 310 may add original gray-scale data of each of all sub-pixels of a $(8i-7)^{th}$ row, a $(8i-4)^{th}$ row, a $(8i-2)^{th}$ row and a $(8i-1)^{th}$ row in the same frame with the first value and deduct original gray-scale data of each of all sub-pixels of a $(8i-6)^{th}$ row, a $(8i-5)^{th}$ row, a $(8i-3)^{th}$ row and a $(8i)^{th}$ row in the same frame by the second value, wherein i is a positive integer. For example, in the embodiment illustrated in FIG. 13, the chopper circuit 310 may add original gray-scale data of each of all sub-pixels of a $1^{st}$, a $4^{th}$, a $6^{th}$ and a $7^{th}$ rows in the first frame Frame-1 (or the second frame Frame-2) with the first value and deduct original gray-scale data of each of all sub-pixels of a $2^{nd}$, a $3^{rd}$, a $5^{th}$ and a $8^{th}$ rows in the first frame Frame-1 (or the second frame Frame-2) by the second value.

FIG. 14 is a schematic diagram of two temporally adjacent frames according to another embodiment of the invention. FIG. 14 illustrates a first frame Frame-1 and a second frame Frame-2 that are temporally adjacent to each other. Each box illustrated in FIG. 14 represents a sub-pixel. In FIG. 14, a mark "+" indicates gray-scale data of the sub-pixel being added with a first value, and a mark "−" indicates gray-scale data of the sub-pixel being deducted by a second value. The chopper circuit 310 may add original gray-scale data of each of all sub-pixels of a $(6i-5)^{th}$ column, a $(6i-4)^{th}$ column and a $(6i-3)^{th}$ column in the same frame with the first value and deduct original gray-scale data of each of all sub-pixels of a $(6i-2)^{th}$ column, a $(6i-1)^{th}$ column and a $(6i)^{th}$ column in the same frame by the second value, wherein i is a positive integer. For example, in the embodiment illustrated in FIG. 14, the chopper circuit 310 may add original gray-scale data of each of all sub-pixels of a $1^{st}$, $2^{nd}$, $3^{rd}$, a $7^{th}$ and a $8^{th}$ columns in the first frame Frame-1 (or the second frame Frame-2) with the first value and deduct original gray-scale data of each of all sub-pixels of a $4^{th}$, a $5^{th}$ and a $6^{th}$ columns in the first frame Frame-1 (or the second frame Frame-2) by the second value.

FIG. 15 is a schematic diagram of two temporally adjacent frames according to another embodiment of the invention. FIG. 15 illustrates a first frame Frame-1 and a second frame Frame-2 that are temporally adjacent to each other. Each box illustrated in FIG. 15 represents a sub-pixel. In FIG. 15, a mark "+" indicates gray-scale data of the sub-pixel being added with a first value, and a mark "−" indicates gray-scale data of the sub-pixel being deducted by a second value. The chopper circuit 310 may add original gray-scale data of each of all sub-pixels of a $(8i-7)^{th}$ column, a $(8i-4)^{th}$ column, a $(8i-2)^{th}$ column and a $(8i-1)^{th}$ column in the same frame with the first value and deduct original gray-scale data of each of all sub-pixels of a $(8i-6)^{th}$ column, a $(8i-5)^{th}$ column, a $(8i-3)^{th}$ column and a $(8i)^{th}$ column in the same frame by the second value, wherein i is a positive integer. For example, in the embodiment illustrated in FIG. 15, the chopper circuit 310 may add original gray-scale data of each of all sub-pixels of a $1^{st}$, a $4^{th}$, a $6^{th}$ and a $7^{th}$ columns in the first frame Frame-1 (or the second frame Frame-2) with the first value and deduct original gray-scale data of each of all sub-pixels of a $2^{nd}$, a $3^{rd}$, a $5^{th}$ and a $8^{th}$ columns in the first frame Frame-1 (or the second frame Frame-2) by the second value.

FIG. 16 is a schematic diagram of two temporally adjacent frames according to another embodiment of the invention. FIG. 16 illustrates a first frame Frame-1 and a second frame Frame-2 that are temporally adjacent to each other. Each box illustrated in FIG. 16 represents a sub-pixel. In FIG. 16, a mark "+" indicates gray-scale data of the sub-pixel being added with a first value, and a mark "−" indicates gray-scale data of the sub-pixel being deducted by a second value. In the embodiment illustrated in FIG. 16, the chopper circuit 310 may add original gray-scale data of each of all sub-pixels of a $1^{st}$, a $4^{th}$, a $5^{th}$ and a $8^{th}$ rows in the first frame Frame-1 with the first value and deduct original gray-scale data of each of all sub-pixels of a $2^{nd}$, a $3^{rd}$, a $6^{th}$ and a $7^{th}$ rows in the first frame Frame-1 by the second value. The chopper circuit 310 may add original gray-scale data of each of all sub-pixels of a $2^{nd}$, a $3^{rd}$, a $6^{th}$ and a $7^{th}$ rows in the second frame Frame-2 with the first value and deduct original gray-scale data of each of all sub-pixels of a $1^{st}$, a $4^{th}$, a $5^{th}$ and a $8^{th}$ rows in the second frame Frame-2 by the second value.

FIG. 17, FIG. 18 and FIG. 19 are schematic diagrams of two temporally adjacent frames according to different embodiments of the invention. Each of FIG. 17, FIG. 18 and FIG. 19 illustrates a first frame Frame-1 and a second frame Frame-2 that are temporally adjacent to each other. Each box illustrated in FIG. 17, FIG. 18 and FIG. 19 represents a sub-pixel. In FIG. 17, FIG. 18 and FIG. 19, a mark "+" indicates gray-scale data of the sub-pixel being added with a first value, and a mark "−" indicates gray-scale data of the sub-pixel being deducted by a second value.

In some embodiments, the chopper circuit 310 may perform the aforementioned adjustment operations (the addition with the first value and/or the deduction by the second value) on the original gray-scale data of all the frames that are temporally adjacent in order. In some other embodiments, the chopper circuit 310 may perform the aforementioned adjustment operations on original gray-scale data of a part of the frames, but not perform the aforementioned adjustment operations on original gray-scale data of the other part of the frames.

Figure 20:
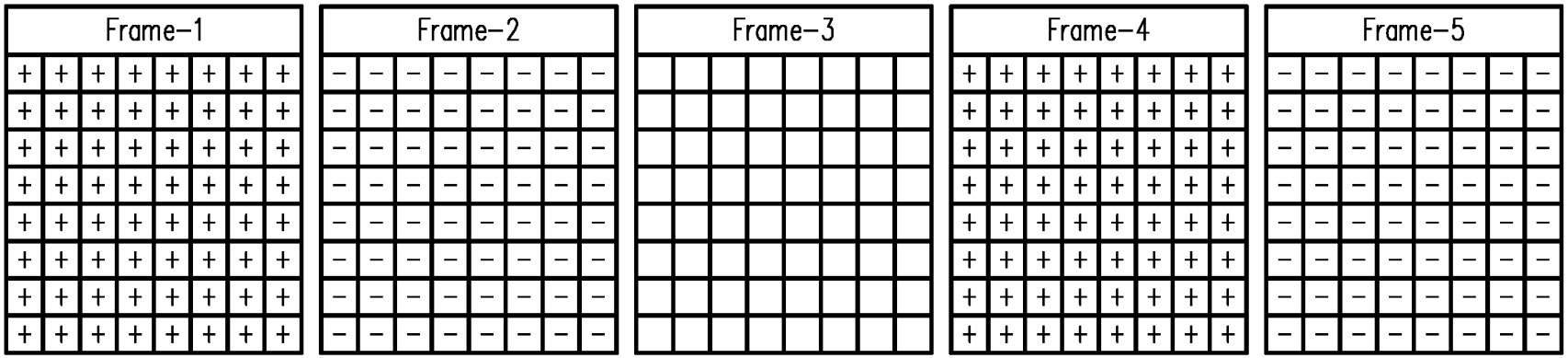
FIG. 20 is a schematic diagram of five temporally adjacent frames according to yet another embodiment of the invention.

For example, FIG. 20 is a schematic diagram of five temporally adjacent frames according to yet another embodiment of the invention. FIG. 20 illustrates a first frame Frame-1, a second frame Frame-2, a third frame Frame-3, a fourth frame Frame-4 and a fifth frame Frame-5 that are temporally adjacent to one another. Each box illustrated in FIG. 20 represents a sub-pixel. In FIG. 20, a mark "+" indicates gray-scale data of the sub-pixel being added with a first value, a mark "−" indicates gray-scale data of the sub-pixel being deducted by a second value, and a box with no mark indicates that gray-scale data of the sub-pixel is not adjusted. In the embodiment illustrated in FIG. 20, adjustment operations similar to those as illustrated in FIG. 9 are performed on the first frame Frame-1 and the second frame Frame-2, the adjustment operations are also performed on the fourth frame Frame-4 and the fifth frame Frame-5, and the adjustment operations are not performed on the third frame Frame-3.

In some other embodiments, the frame stream Din1 includes a first sub-pixel, a second sub-pixel, a third sub-pixel and a fourth sub-pixel that are temporally (or spatially) adjacent to one another. The chopper circuit 310 may add original gray-scale data of the first sub-pixel with a first value to serve as new gray-scale data of the first sub-pixel, deduct original gray-scale data of the second sub-pixel by a second value to serve as new gray-scale data of the second sub-pixel, serve original gray-scale data of the third sub-pixel as new gray-scale data of the third sub-pixel and serve original gray-scale data of the fourth sub-pixel as new gray-scale data of the fourth sub-pixel.

For example, FIG. 21 is a schematic diagram of different sub-pixels of one frame Frame-1 according to still another embodiment of the present invention. Each box illustrated in FIG. 21 represents a sub-pixel. In FIG. 21, a mark "+" indicates gray-scale data of the sub-pixel being added with a first value, a mark "−" indicates gray-scale data of the sub-pixel being deducted by a second value, and a box with no mark indicates that gray-scale data of the sub-pixel is not adjusted. In the embodiment illustrated in FIG. 21, the chopper circuit 310 may add original gray-scale data of each of all sub-pixels of a $1^{st}$ and a $5^{th}$ rows in the frame Frame-1 with the first value, deduct original gray-scale data of each of all sub-pixels of a $2^{nd}$ and a $6^{th}$ rows in the frame Frame-1 by the second value and serve original gray-scale data of each of all sub-pixels of a $3^{rd}$, a $4^{th}$, a $7^{th}$ and a $8^{th}$ rows in the frame Frame-1 as new gray-scale data (i.e., the chopper circuit 310 does not adjust the gray-scale data of these sub-pixels).

FIG. 22 is a schematic diagram of different sub-pixels of one frame Frame-1 according to still another embodiment of the present invention. Each box illustrated in FIG. 22 represents a sub-pixel. In FIG. 22, a mark "+" indicates gray-scale data of the sub-pixel being added with a first value, a mark "−" indicates gray-scale data of the sub-pixel being deducted by a second value, and a box with no mark indicates that gray-scale data of the sub-pixel is not adjusted. In the embodiment illustrated in FIG. 22, the chopper circuit 310 may add original gray-scale data of each of all sub-pixels of a $1^{st}$, a $3^{rd}$ and a $7^{th}$ columns in the frame Frame-1 with the first value, deduct original gray-scale data of each of all sub-pixels of a $4^{th}$ and a $6^{th}$ columns in the frame Frame-1 by the second value and serve original gray-scale data of each of all sub-pixels of a $2^{nd}$, a $5^{th}$ and a $8^{th}$ columns in the frame Frame-1 as new gray-scale data (i.e., the chopper circuit 310 does not adjust the gray-scale data of these sub-pixels).

It should be noted that no matter whether the display panel 10 is an organic light emitting diode (OLED) display panel, a liquid crystal display (LCD) panel or any other display panel, the source driver 300 may facilitate the output voltages of the source driver circuit 320 to achieve more preferable linearity with visual average characteristics of human eyes.

Taking an LCD panel as an example, its liquid crystal characteristics have an issue of polarization. Thus, a general type source driver has to perform a polarity conversion operation on the LCD panel to overcome the issue of polarization. When a voltage difference between a positive polarity voltage and a reference voltage (e.g., a ground voltage or a common voltage VCOM) is identical to that between a negative polarity voltage and the reference voltage, a gray scale of the positive polarity voltage is identical to a gray scale of the negative polarity voltage. Therefore, the source driver may perform the polarity conversion operation (i.e., switch between the positive polarity voltage and the negative polarity voltage) to prevent the liquid crystal from being polarized. The source driver 300 may apply the contents related to the embodiments described above in positive polarity driving and negative polarity driving. With the visual average characteristics of human eyes, the gray scales of the LCD panel may achieve more preferable linearity.

Figure 23:
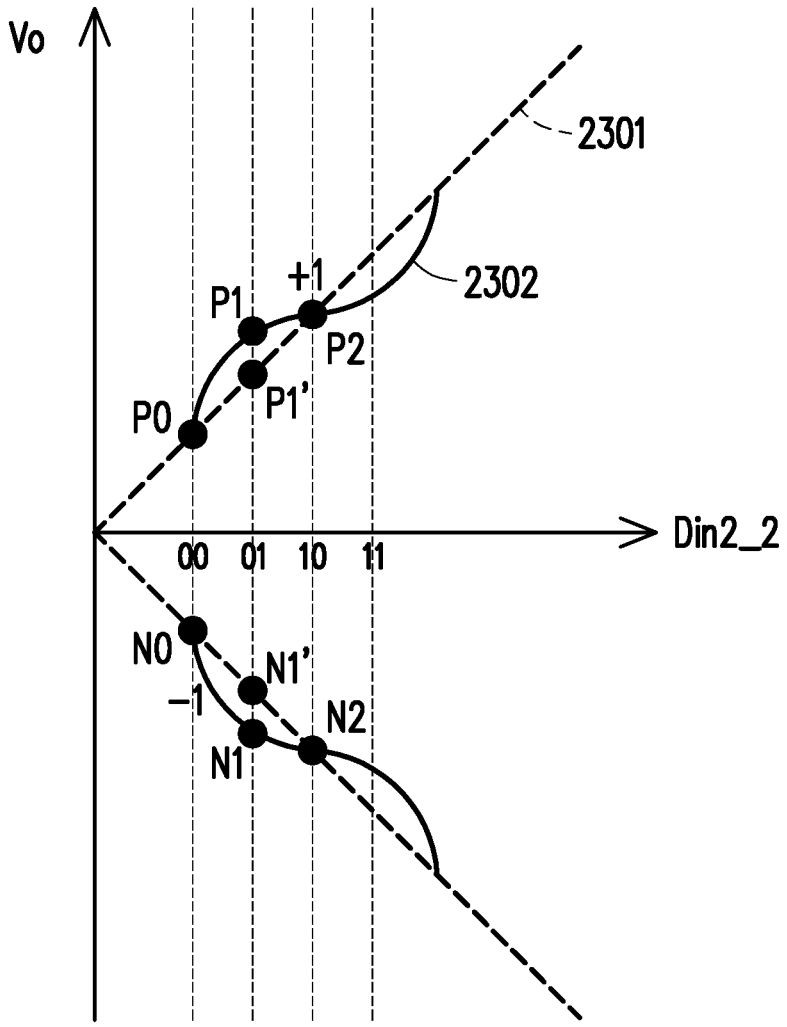
FIG. 23 is a schematic characteristic curve diagram of a driving voltage Vo output by the SOP circuit 322 depicted in FIG. 3.

FIG. 23 is a schematic characteristic curve diagram of a driving voltage Vo output by the SOP circuit 322 depicted in FIG. 3. In FIG. 23, the horizontal axis represents the second portion of bits Din2_2 of the new gray-scale data in the frame stream Din2, and the vertical axis represents the driving voltage Vo output by the SOP circuit 322. A characteristic curve 2301 illustrated in FIG. 23 shows an ideal characteristic curve of the driving voltage Vo, and a characteristic curve 2302 illustrated in FIG. 23 shows an actual characteristic curve of the driving voltage Vo.

For descriptive convenience, in the embodiment illustrated in FIG. 23, the number of the "second portion of bits Din2_2" is assumed as 2. The driving voltage Vo may be interpolated by the SOP circuit 322 according to the "second portion of bits Din2_2". As shown in FIG. 23, when the second portion bit Din2_2 is "00", the level of the ideal output Vo is as indicated by the point P0 and the point N0. When the second portion bit Din2_2 is "01", the level of the ideal output Vo is as indicated by the point P1' and the point N1'. When the second portion bit Din2_2 is "10", the level of the ideal output Vo is as indicated by the point P2 and the point N2. Because of the nonlinear characteristic of the SOP circuit 322, when the second portion bit Din2_2 is "01", the level of the actual output Vo is the point P1 and the point N1. At this time, the source driver 300 can be applied to the positive polarity driving and the negative polarity driving in the related description of the above embodiments to achieve linearization after the visual effect averaging.

For example, the second portion bit Din2_2 (ie, "01") of the point P1 is incremented by 1, so that the second portion bit Din2_2 becomes "10" as the output Vo of the point P2. Further, the second portion bit Din2_2 of the point N1 (i.e., "01") is decremented by 1, so that the second portion bit Din2_2 becomes "00" as the output Vo of the point N0. Since the positive polarity voltage and the negative polarity voltage have symmetry characteristics (that is, the brightness of point P2 is equal to the brightness of point N2), the output Vo from point P0 (corresponding to point N0) and point P2 is time-dependent. After averaging with the spatial visual effect, the output Vo of the point P1' can be obtained. The output Vo of the point N1' can be obtained by visually averaging the output Vo of the point N0 and the point N2 by time and space.

The second portion bit Din2_2 (ie, "01") of the point P1 is incremented by 1, so that the second portion bit Din2_2 is changed to "10" as the output Vo of the point P2. Further, the second portion bit Din2_2 (i.e., "01") of the point P1 is decremented by 1, so that the second portion bit Din2_2 becomes "00" as the output Vo of the point P0. Therefore, the output Vo of the point P1' can be obtained by visually averaging the output Vo of the point P0 and the point P2 by time (Frame) and space (Line/Column).

The second portion bit Din2_2 (ie, "01") of the point N1 is incremented by 1, so that the second portion bit Din2_2 becomes "10" as the output Vo of the point N2. Further, the second portion bit Din2_2 of the point N1 (i.e., "01") is decremented by 1, so that the second portion bit Din2_2 becomes "00" as the output Vo of the point N0. Therefore, the output Vo of the point N0 and the point N2 is visually averaged by time (Frame) and space (Line/Column), and the output Vo of the N1' point is obtained.

Therefore, it is explained by this embodiment that the output voltage of the SOP circuit 322 can be made to achieve better linear characteristics by visual effect averaging, regardless of whether it is applied to an OLED or an LCD.

Based on different design demands, the chopper circuit 310 may be implemented in a form of hardware, firmware, software (i.e., programs) or in a combination of many of the aforementioned three forms.

In terms of the hardware form, the blocks of the chopper circuit 310 may be implemented in a logic circuit on an integrated circuit. Related functions of the chopper circuit 310 may be implemented in a form of hardware by utilizing hardware description languages (e.g., Verilog HDL or VHDL) or other suitable programming languages. For instance, the related functions of the chopper circuit 310 may be implemented in one or more controllers, a micro-controller, a microprocessor, an application-specific integrated circuit (ASIC), a digital signal processor (DSP), a field programmable gate array (FPGA) and/or various logic blocks, modules and circuits in other processing units.

In terms of the software form and/or the firmware form, the related functions of the chopper circuit 310 may be implemented as programming codes. For example, the chopper circuit 310 may be implemented by using general programming languages (e.g., C or C++) or other suitable programming languages. The programming codes may be recorded/stored in recording media. The aforementioned recording media include a read only memory (ROM), a storage device and/or a random access memory (RAM). The programming codes may be accessed from the recording medium and executed by a central processing unit (CPU), a controller, a micro-controller or a microprocessor to accomplish the related functions. As for the recording medium, a non-transitory computer readable medium, such as a tape, a disk, a card, a semiconductor memory or a programming logic circuit, may be used.

Based on the above, the source driver and the operation method provided by the embodiments of the invention can perform addition and deduction respectively on two sets of gray-scale data which are temporally (and/or spatially) adjacent to each other, so as to compensate the nonlinearity error caused by the source driver circuit. As for a visual effect, since the nonlinearity error can be effectively compensated, the source driver can improve display quality for the panel.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A source driver, comprising:

a chopper circuit, configured to receive a frame stream comprising original gray-scale data of a first sub-pixel and original gray-scale data of a second sub-pixel, wherein the first sub-pixel and the second sub-pixel are temporally or spatially adjacent to each other, and the chopper circuit is further configured to add the original gray-scale data of the first sub-pixel with a first value to serve as new gray-scale data of the first sub-pixel and deduct the original gray-scale data of the second sub-pixel by a second value to serve as new gray-scale data of the second sub-pixel, wherein the first value and the second value are both positive values or both negative values; and a source driver circuit, configured to receive the new gray-scale data of the first sub-pixel and the new gray-scale data of the second sub-pixel, generate a first driving voltage for the first sub-pixel according to the new gray-scale data of the first sub-pixel and generate a second driving voltage for the second sub-pixel according to the new gray-scale data of the second sub-pixel, wherein the source driver circuit comprises a digital-to-analog conversion circuit and a source operational amplifier circuit coupled to the digital-to-analog conversion circuit, and the source operational amplifier circuit comprises a differential difference amplifier (DDA).

2. The source driver according to claim 1, wherein the first sub-pixel is temporally or spatially directly adjacent to the second sub-pixel.

3. The source driver according to claim 1, wherein at least one sub-pixel temporally or spatially exists between the first sub-pixel and the second sub-pixel.

4. The source driver according to claim 1, wherein the first sub-pixel is in a first frame, the second sub-pixel is in a second frame, a third sub-pixel is in a third frame, a fourth sub-pixel is in a fourth frame, the first frame, the second frame, the third frame and the fourth frame are temporally adjacent to one another, the first sub-pixel, the second sub-pixel, the third sub-pixel and the fourth sub-pixel spatially have the same position, and the chopper circuit adds original gray-scale data of the third sub-pixel with a third value to serve as new gray-scale data of the third sub-pixel and deducts original gray-scale data of the fourth sub-pixel by a fourth value to serve as new gray-scale data of the fourth sub-pixel, wherein the third value and the fourth value are both positive values.

5. The source driver according to claim 1, wherein the first sub-pixel is in a first frame, the second sub-pixel is in a second frame, a third sub-pixel is in a third frame, a fourth sub-pixel is in a fourth frame, the first frame, the second frame, the third frame and the fourth frame are temporally adjacent to one another, the first sub-pixel, the second sub-pixel, the third sub-pixel and the fourth sub-pixel spatially have the same position, and the chopper circuit deducts original gray-scale data of the third sub-pixel by a third value to serve as new gray-scale data of the third sub-pixel and adds original gray-scale data of the fourth sub-pixel with a fourth value to serve as new gray-scale data of the fourth sub-pixel, wherein the third value and the fourth value are both positive values.

6. The source driver according to claim 1, wherein the first sub-pixel and the second sub-pixel are located in a first frame and spatially adjacent to each other, a third sub-pixel and a fourth sub-pixel are located in a second frame, the first frame and the second frame are temporally adjacent to each other, the first sub-pixel and the third sub-pixel spatially have the same position, the second sub-pixel and the fourth sub-pixel spatially have the same position, and the chopper circuit adds original gray-scale data of the third sub-pixel with a third value to serve as new gray-scale data of the third sub-pixel and deducts original gray-scale data of the fourth sub-pixel by a fourth value to serve as new gray-scale data of the fourth sub-pixel, wherein the third value and the fourth value are both positive values.

7. The source driver according to claim 1, wherein the first sub-pixel and the second sub-pixel are located in a first frame and spatially adjacent to each other, a third sub-pixel and a fourth sub-pixel are located in a second frame, the first frame and the second frame are temporally adjacent to each other, the first sub-pixel and the third sub-pixel spatially have the same position, the second sub-pixel and the fourth sub-pixel spatially have the same position, and the chopper circuit deducts original gray-scale data of the third sub-pixel by a third value to serve as new gray-scale data of the third sub-pixel and adds original gray-scale data of the fourth sub-pixel with a fourth value to serve as new gray-scale data of the fourth sub-pixel, wherein the third value and the fourth value are both positive values.

8. The source driver according to claim 1, wherein the source driver circuit, wherein:

the digital-to-analog conversion circuit is configured to convert a first portion of bits of the new gray-scale data of the first sub-pixel into a first high voltage and a first low voltage, and configured to convert a first portion of bits of the new gray-scale data of the second sub-pixel into a second high voltage and a second low voltage; and the source operational amplifier circuit receives the first high voltage and the first low voltage, and configured to obtain the first driving voltage for the first sub-pixel according to the first high voltage and the first low voltage, wherein the source operational amplifier circuit is further configured to receive the second high voltage and the second low voltage, and configured to obtain the second driving voltage for the second sub-pixel according to the second high voltage and the second low voltage.

9. The source driver according to claim 8, wherein the source operational amplifier circuit is configured to generate the first driving voltage by interpolating the first high voltage and the first low voltage according to a second portion of bits of the new gray-scale data of the first sub-pixel, and further configured to generate the second driving voltage by interpolating the second high voltage and the second low voltage according to a second portion of bits of the new gray-scale data of the second sub-pixel.

10. The source driver according to claim 9, wherein the number of bits of the second portion of bits of the new gray-scale data in any one of the first sub-pixel and the second sub-pixel is n, and the first value and the second value are $2^{(n-2)}$, n being equal to or greater than 2.

11. The source driver according to claim 1, wherein the first sub-pixel and the second sub-pixel are two sub-pixels located at the same position in a current frame and a previous frame, respectively.

12. The source driver according to claim 1, wherein the first sub-pixel and the second sub-pixel are two sub-pixels located at adjacent positions in the same frame.

13. The source driver according to claim 1, wherein the first value is equal to the second value.

14. The source driver according to claim 1, wherein the first value is not equal to the second value.

15. The source driver according to claim 1, wherein the chopper circuit adds original gray-scale data of each of all sub-pixels in a first frame with the first value to serve as new gray-scale data of each of the sub-pixels in the first frame and deducts original gray-scale data of each of all sub-pixels in a second frame by the second value to serve as new gray-scale data of each of the sub-pixels in the second frame.

16. The source driver according to claim 1, wherein the chopper circuit adds original gray-scale data of each of all sub-pixels of one of each odd row and each even row in the same frame with the first value and deducts original gray-scale data of each of all sub-pixels of the other one of each odd row and each even row in the same frame by the second value.

17. The source driver according to claim 1, wherein the chopper circuit adds original gray-scale data of each of all sub-pixels of a $(4i-3)^{th}$ row and a $(4i-2)^{th}$ row in the same frame with the first value and deducts original gray-scale data of each of all sub-pixels of a $(4i-1)^{th}$ row and a $(4i)^{th}$ row in the same frame by the second value, wherein i is a positive integer.

18. The source driver according to claim 1, wherein the chopper circuit adds original gray-scale data of each of all sub-pixels of a $(4i-3)^{th}$ row and a $(4i)^{th}$ row in the same frame with the first value and deducts original gray-scale data of each of all sub-pixels of a $(4i-1)^{th}$ row and a $(4i-2)^{th}$ row in the same frame by the second value, wherein i is a positive integer.

19. The source driver according to claim 1, wherein the chopper circuit adds original gray-scale data of each of all sub-pixels of a $(8i-7)^{th}$ row, a $(8i-4)^{th}$ row, a $(8i-2)^{th}$ row and a $(8i-1)^{th}$ row in the same frame with the first value and deducts original gray-scale data of each of all sub-pixels of a $(8i-6)^{th}$ row, a $(8i-5)^{th}$ row, a $(8i-3)^{th}$ row and a $(8i)^{th}$ row in the same frame by the second value, wherein i is a positive integer.

20. The source driver according to claim 1, wherein the chopper circuit adds original gray-scale data of each of all sub-pixels of a $(6i-5)^{th}$ column, a $(6i-4)^{th}$ column and a $(6i-3)^{th}$ column in the same frame with the first value and deducts original gray-scale data of each of all sub-pixels of a $(6i-2)^{th}$ column, a $(6i-1)^{th}$ column and a $(6i)^{th}$ column in the same frame by the second value, wherein i is a positive integer.

21. The source driver according to claim 1, wherein the chopper circuit adds original gray-scale data of each of all sub-pixels of a $(8i-7)^{th}$ column, a $(8i-4)^{th}$ column, a $(8i-2)^{th}$ column and a $(8i-1)^{th}$ column in the same frame with the first value and deducts original gray-scale data of each of all sub-pixels of a $(8i-6)^{th}$ column, a $(8i-5)^{th}$ column, a $(8i-3)^{th}$ column and a $(8i)^{th}$ column in the same frame by the second value, wherein i is a positive integer.

22. The source driver according to claim 1, wherein the frame stream further comprises a third sub-pixel and a fourth sub-pixel temporally or spatially adjacent to each other, and the chopper circuit serves original gray-scale data of the third sub-pixel as new gray-scale data of the third sub-pixel and serves original gray-scale data of the fourth sub-pixel as new gray-scale data of the fourth sub-pixel.

23. An operation method of a source driver, comprising:

receiving a frame stream by a chopper circuit, wherein the frame stream comprises original gray-scale data of a first sub-pixel and original gray-scale data of a second sub-pixel, and the first sub-pixel and the second sub-pixel are temporally or spatially adjacent to each other;

adding the original gray-scale data of the first sub-pixel with a first value to serve as new gray-scale data of the first sub-pixel by the chopper circuit;

deducting the original gray-scale data of the second sub-pixel by a second value to serve as new gray-scale data of the second sub-pixel by the chopper circuit, wherein the first value and the second value are both positive values or both negative values;

generating a first driving voltage for the first sub-pixel according to the new gray-scale data of the first sub-pixel by a source driver circuit; and generating a second driving voltage for the second sub-pixel according to the new gray-scale data of the second sub-pixel by the source driver circuit, wherein the source driver circuit comprises a digital-to-analog conversion circuit and a source operational amplifier circuit, and the source operational amplifier circuit comprises a differential difference amplifier (DDA).

24. The operation method according to claim 23, wherein the first sub-pixel is temporally or spatially directly adjacent to the second sub-pixel.

25. The operation method according to claim 23, wherein at least one sub-pixel temporally or spatially exists between the first sub-pixel and the second sub-pixel.

26. The operation method according to claim 23, wherein the first sub-pixel is in a first frame, the second sub-pixel is in a second frame, a third sub-pixel is in a third frame, a fourth sub-pixel is in a fourth frame, the first frame, the second frame, the third frame and the fourth frame are temporally adjacent to one another, the first sub-pixel, the second sub-pixel, the third sub-pixel and the fourth sub-pixel spatially have the same position, and the operation method further comprises:

adding original gray-scale data of the third sub-pixel with a third value to serve as new gray-scale data of the third sub-pixel by the chopper circuit, wherein the third value is a positive value; and deducting original gray-scale data of the fourth sub-pixel by a fourth value to serve as new gray-scale data of the fourth sub-pixel by the chopper circuit, wherein the fourth value is a positive value.

27. The operation method according to claim 23, wherein the first sub-pixel is in a first frame, the second sub-pixel is in a second frame, a third sub-pixel is in a third frame, a fourth sub-pixel is in a fourth frame, the first frame, the second frame, the third frame and the fourth frame are temporally adjacent to one another, the first sub-pixel, the second sub-pixel, the third sub-pixel and the fourth sub-pixel spatially have the same position, and the operation method further comprises:

deducting original gray-scale data of the third sub-pixel by a third value to serve as new gray-scale data of the third sub-pixel by the chopper circuit, wherein the third value is a positive value; and adding original gray-scale data of the fourth sub-pixel with a fourth value to serve as new gray-scale data of the fourth sub-pixel by the chopper circuit, wherein the fourth value is a positive value.

28. The operation method according to claim 23, wherein the first sub-pixel and the second sub-pixel are located in a first frame and spatially adjacent to each other, a third sub-pixel and a fourth sub-pixel are located in a second frame, the first frame and the second frame are temporally adjacent to each other, the first sub-pixel and the third sub-pixel spatially have the same position, the second sub-pixel and the fourth sub-pixel spatially have the same position, and the operation method further comprises:

adding original gray-scale data of the third sub-pixel with a third value to serve as new gray-scale data of the third sub-pixel by the chopper circuit, wherein the third value is a positive value; and deducting original gray-scale data of the fourth sub-pixel by a fourth value to serve as new gray-scale data of the fourth sub-pixel by the chopper circuit, wherein the fourth value is a positive value.

29. The operation method according to claim 23, wherein the first sub-pixel and the second sub-pixel are located in a first frame and spatially adjacent to each other, a third sub-pixel and a fourth sub-pixel are located in a second frame, the first frame and the second frame are temporally adjacent to each other, the first sub-pixel and the third sub-pixel spatially have the same position, the second sub-pixel and the fourth sub-pixel spatially have the same position, and the operation method further comprises:

deducting original gray-scale data of the third sub-pixel by a third value to serve as new gray-scale data of the third sub-pixel by the chopper circuit, wherein the third value is a positive value; and adding original gray-scale data of the fourth sub-pixel with a fourth value to serve as new gray-scale data of the fourth sub-pixel by the chopper circuit, wherein the fourth value is a positive value.

30. The operation method according to claim 23, wherein the step of generating the first driving voltage and the step of generating the second driving voltage comprise:

converting a first portion of bits of the new gray-scale data of the first sub-pixel into a first high voltage and a first low voltage by the digital-to-analog conversion circuit;

converting a first portion of bits of the new gray-scale data of the second sub-pixel into a second high voltage and a second low voltage by the digital-to-analog conversion circuit;

obtaining the first driving voltage for the first sub-pixel according to the first high voltage and the first low voltage by the source operational amplifier circuit; and obtaining the second driving voltage for the second sub-pixel according to the second high voltage and the second low voltage by the source operational amplifier circuit.

31. The operation method according to claim 30, wherein the source operational amplifier circuit is configured to generate the first driving voltage by interpolating the first high voltage and the first low voltage according to a second portion of bits of the new gray-scale data of the first sub-pixel, and further configured to generate the second driving voltage by interpolating the second high voltage and the second low voltage according to a second portion of bits of the new gray-scale data of the second sub-pixel.

32. The operation method according to claim 31, wherein the number of bits of the second portion of bits of the new gray-scale data in any one of the first sub-pixel and the second sub-pixel is n, and the first value and the second value are $2^{(n-2)}$, n being equal to or greater than 2.

33. The operation method according to claim 23, wherein the first sub-pixel and the second sub-pixel are two sub-pixels located at the same position in a current frame and a previous frame.

34. The operation method according to claim 23, wherein the first sub-pixel and the second sub-pixel are two sub-pixels located at adjacent positions in the same frame, respectively.

35. The operation method according to claim 23, wherein the first value is equal to the second value.

36. The operation method according to claim 23, wherein the first value is not equal to the second value.

37. The operation method according to claim 23, further comprising:

adding original gray-scale data of each of all sub-pixels in the first frame with the first value to serve as new gray-scale data of each of the sub-pixels in the first frame by the chopper circuit; and deducting original gray-scale data of each of all sub-pixels in the second frame by the second value to serve as new gray-scale data of each of the sub-pixels in the second frame.

38. The operation method according to claim 23, further comprising:

adding original gray-scale data of each of all sub-pixels of one of each odd row and each even row in the same frame with the first value by the chopper circuit; and deducting original gray-scale data of each of all sub-pixels of the other one of each odd row and each even row in the same frame by the second value by the chopper circuit.

39. The operation method according to claim 23, wherein the frame stream further comprises a third sub-pixel and a fourth sub-pixel temporally or spatially adjacent to each other, and the operation method further comprises:

serving original gray-scale data of the third sub-pixel as new gray-scale data of the third sub-pixel; and serving original gray-scale data of the fourth sub-pixel as new gray-scale data of the fourth sub-pixel by the chopper circuit.

40. A source driver, comprising:

a chopper circuit, configured to receive a frame stream comprising original gray-scale data of a plurality of sub-pixels, and further configured to convert the original gray-scale data of the sub-pixels to new gray-scale data of the sub-pixels; and a source driver circuit, configured to receive the new gray-scale data of the sub-pixels, and generate a plurality of driving voltages for the sub-pixels according to the new gray-scale data of the sub-pixels, wherein the source driver circuit comprises a digital-to-analog conversion circuit and a source operational amplifier circuit coupled to the digital-to-analog conversion circuit, and the source operational amplifier circuit comprises a differential difference amplifier (DDA), and the chopper circuit is configured to convert the original gray-scale data of the sub-pixels to compensate non-linear characteristics of the DDA.

41. The source driver according to claim 40 wherein the sub-pixels comprise one or more first sub-pixels and one or more second sub-pixels temporally or spatially adjacent to the one or more first sub-pixels, and the chopper circuit is configured to increase the original gray-scale data of the one or more first sub-pixels to serve as the new gray-scale data of the one or more first sub-pixels and decrease original gray-scale data of the one or more second sub-pixels to serve as the new gray-scale data of the one or more second sub-pixels.

42. The source driver according to claim 41, wherein a total number of sub-pixels having the increased gray-scale data is equal to a total number of sub-pixels having the decreased gray-scale data for a plurality of consecutive frames.

* * * * *